US008360131B2

(12) United States Patent
Kashani et al.

(10) Patent No.: US 8,360,131 B2
(45) Date of Patent: Jan. 29, 2013

(54) DIMENSION ADJUSTABLE COMPOSITE DOORS, BI-FOLD DOORS, AND METHODS OF CONSTRUCTION THEREOF

(75) Inventors: Ali Kashani, Houston, TX (US); Reza Kashani, Houston, TX (US)

(73) Assignee: Home Fashion Technologies, Inc., Houston, TX (US)

( * ) Notice: Subject to any disclaimer, the term of this patent is extended or adjusted under 35 U.S.C. 154(b) by 0 days.

(21) Appl. No.: 13/107,676

(22) Filed: May 13, 2011

(65) Prior Publication Data

US 2011/0214356 A1 Sep. 8, 2011

Related U.S. Application Data

(62) Division of application No. 11/736,206, filed on Apr. 17, 2007, now abandoned.

(60) Provisional application No. 60/802,895, filed on May 24, 2006, provisional application No. 60/894,529, filed on Mar. 13, 2007.

(51) Int. Cl.
*E05D 15/00* (2006.01)

(52) U.S. Cl. ..... 160/213; 160/236

(58) Field of Classification Search ..... 160/213, 160/206, 229.1, 236, 117, 40, 375; 52/473; 49/74.1

See application file for complete search history.

(56) References Cited

U.S. PATENT DOCUMENTS

| | | | | |
|---|---|---|---|---|
| 3,394,518 | A | 7/1968 | Worrell, Jr. | |
| 3,797,186 | A | 3/1974 | Smith | |
| 3,985,175 | A | 10/1976 | Pukl | |
| 4,332,287 | A | 6/1982 | Stolpe | |
| 4,380,260 | A * | 4/1983 | Labelle | 160/235 |
| 4,939,880 | A | 7/1990 | Wang | |
| 5,099,903 | A | 3/1992 | Chen | |
| 5,191,735 | A | 3/1993 | Ross | |
| 5,379,551 | A | 1/1995 | Swapp | |
| 5,490,353 | A | 2/1996 | McLaughlin | |
| 5,704,182 | A | 1/1998 | Schiedegger | |
| 5,848,505 | A | 12/1998 | Taylor | |
| 5,996,298 | A | 12/1999 | Wenzlaff et al. | |
| 6,066,680 | A | 5/2000 | Cope | |
| 6,439,291 | B1 | 8/2002 | Amin-Javaheri | |
| 6,481,179 | B2 | 11/2002 | Zen | |
| 6,560,941 | B1 | 5/2003 | French | |
| 2001/0003889 | A1 | 6/2001 | Zen | |
| 2003/0101653 | A1 | 6/2003 | Biro | |
| 2004/0026679 | A1 | 2/2004 | Terrels et al. | |
| 2004/0068936 | A1 | 4/2004 | Amin-Javaheri | |

FOREIGN PATENT DOCUMENTS

| | | |
|---|---|---|
| FR | 2770571 | 5/1999 |
| NL | 8802197 | 4/1990 |

OTHER PUBLICATIONS

Blancquaert, K., International Search Report for International Patent Application No. PCT/US2007/012601, dated Feb. 21, 2008, European Patent Office.

Blancquaert, K., Written Opinion for International Patent Application No. PCT/US2007/012601, dated Feb. 21, 2008, European Patent Office.

* cited by examiner

*Primary Examiner* — David Purol

(74) *Attorney, Agent, or Firm* — Sutton McAughan Deaver PLLC

(57) ABSTRACT

Composite bi-fold doors and other composite closures having improved assemblies are described, wherein the assemblies provide enhanced strength and durability of the doors and their construction while simultaneously maintaining their aesthetics. Additional improved bi-fold door and semi-solid door assemblies are also provided, which allow for the dimensional adjustment of the height of the doors by the installer as necessary, while simultaneously maintaining the structural integrity of the doors following the height adjustment.

20 Claims, 15 Drawing Sheets

DIMENSION ADJUSTABLE COMPOSITE DOORS, BI-FOLD DOORS, AND METHODS OF CONSTRUCTION THEREOF

CROSS REFERENCE TO RELATED APPLICATIONS

The present application is a divisional application, and claims priority benefit, of U.S. patent application Ser. No. 11/736,206, filed Apr. 17, 2007, and published as U.S. Patent Application Publication No. 2007/0272118, which claims priority to U.S. Provisional Patent Application Ser. No. 60/802,895 filed May 24, 2006, and U.S. Provisional Patent Application Ser. No. 60/894,529, filed Mar. 13, 2007. The contents the above three applications are incorporated herein by specific reference in their entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The present disclosure relates generally to the construction of and methods of construction of composite closures, such as entryway doors, bi-fold doors, and the like for openings between rooms in structures. More specifically, it relates to the construction of doors, including both single doors, bi-fold doors, and the like that allow for the doors to be constructed with increased strength, durability, and lifetime with the optional ability to be height modified so as to fit into an opening as necessary.

2. Description of the Related Art

As the market for customized homes and do-it-yourselfers increases, the demand for more decorative and architecturally interesting closures for openings, such as closets, cupboards, laundry rooms, linen closets, bath rooms and the like, have similarly increased. Various materials are used to construct architectural doors. Architectural wood doors are well known. Wood doors, however, when exposed to humidity in general (e.g., in humid climates, or in bathrooms), and especially when exposed to water, rain, snow, sun and other elements require frequent maintenance including the application of various stains and clear coats in order to prevent cracking, discoloration, deformation, and other similarly unwanted maladies. Wood doors can also warp and are subject to rot and insect damage, such as from termites. There is therefore a need for doors having low maintenance that are not susceptible to the elements. As a result of this need, various alternatives to wood have been developed and are available.

Doors having steel, aluminum, or other low-weight metals or bi-metals as facing panels or structural components are one of the common alternatives to wood architectural doors. While these metal panel doors are fairly inexpensive to construct and are somewhat dimensionally stable under temperature fluctuations, the initial start up costs associated with producing a metal door is high. High pressure tools are often required to form the panels. However, unless the metal panels used have a high thickness, doors constructed with metal panels are often subject to denting. Additionally, metal doors are often subject to oxidation and rust formation, which can adversely affect their aesthetic appearance and functionability. Similarly, due to the nature of their construction, metal doors often emit an unpleasant squeaking noise during their opening and closing, due to effects such as humidity and air oxidation of their working parts. In addition, imparting a crisp multi-directional wood grain appearance to a metal panel door to increase its aesthetic qualities is difficult and costly, and so this is typically not done.

Doors constructed with fiberglass facing panels are another, increasingly-common option. Fiberglass facing panels can have significant benefits over steel and other metals. For example, fiberglass facing panels can be constructed to resemble a panelized wooden door. However, such fiberglass doors are very expensive to construct. And, like steel or other metal doors, the start up costs associated with production is high and production rates are very slow. In example, expensive molds must often be used to produce the panels having a panelized wooden door appearance. The raw materials for fiberglass doors are also relatively expensive. Fiberglass doors also have problems with dimensional stability resulting from temperature fluctuations. Such dimensional instability may eventually damage a door, necessitating its (sometimes costly) replacement.

Traditionally, entrance doors to rooms, as well as bi-fold, half doors, and sliding doors (such as pocket doors) have been made of wood, but the ever-increasing cost of wood as lumber supplies decrease has caused the industry to search for other suitable materials. One economical approach has been with the use of aluminum for fabricating such door closures, due to the economics and the lightweight nature of the product.

However, while economical to make and produce, these lightweight doors suffer from a variety of problems similar to other metal doors as elucidated above, including low resistance to scratching and denting, and poor paintability characteristics. For example, the amount of force needed to dent or bend aluminum closures is relatively low compared to other approaches and materials, with such resultant malformations impacting both the aesthetics of the door as well as the operability of the door once it has been bent or dented. Additionally, such doors are typically available only in a limited number of colors, and cannot easily be painted in an acceptable manner or made to appear like real wood.

Several manufacturers have turned to fabricating such bi-fold type doors and standard doors from alternative materials, most commonly synthetic resins, using injection molding techniques, such as described in U.S. Pat. No. 3,985,175. However, the injection molding process is limited in its application. Typically, the injection molding process involves making two rectangular hollow pans and joining the pans together by the edges to form a hollow door. According to U.S. Pat. No. 3,985,175, particular types of door construction is described, wherein a front face is made of injection molded plastic and has reinforcing members on the back side but no back face. Such a construction, while serving to maintain rigidity, provides a door having only one good "facing" side. The resultant door is thus often considered to be unsuited for a wide variety of general applications in the home or office, where it is likely that both faces of the door will be in view.

Others have tried to use a number of composite materials to obtain the desired product. These materials, however, are often not suitable for use in the formation of composite doors from both manufacturing and product lifetime perspectives. For example, several issued patents have suggested the formation of structural members from a polymer and a large amount of wood composite material. The structural members are formed from a composite containing a large amount (30 to 50 wt-%) of sawdust along with 50 to 70 wt-% of a polyvinyl chloride polymer. The composite is reportedly first blended and then extruded into pellets. The pellets are then extruded into the desired structural member. The disclosed composite, however, is not suitable for use in the formation of many types of doors because the material can degrade when exposed to high temperatures. Furthermore, the use of the disclosed, specific composite requires additional manufacturing steps, and the composite must first be pelletized before formation into the final shape as a structural member. Finally, the final product does not have the appearance of real wood, further reducing its commercial appeal.

One of the main problems with full length doors made from injection molded plastic is their lack of rigidity. Therefore, there is a need in the industry for non-wooden doors, including both standard closures for rooms as well as bi-fold closures and sliding doors, which can be readily and economically produced for a variety of architectural openings, and methods for constructing such strengthened closures while maintaining economic integrity. There also exists a need for such alternative closures which are capable of being easily and efficiently tailored to the dimensions of the closure as necessary by the end use, similar to closures constructed of solid wood materials, while maintaining the same aesthetic qualities as they did prior to the custom tailoring. Similarly, it would be advantageous if such wood-alternative closures were capable of being painted or textured in order to provide the appearance of natural wood, increasing the aesthetics of the product closures.

This application for patent discloses polymer-wood composite closures which can be height-adjusted in a manner similar to that done with standard wood doors and closures, methods for making and painting such closures, and methods for their use.

BRIEF SUMMARY OF THE INVENTION

The present invention addresses the above-described problems with standard manufactured closures, such as bi-fold doors, by providing composite closure assemblies with increased strength and stability, and/or a construction which allows for the closure to be height adjusted without adversely affecting the aesthetics of the closure itself In one embodiment of the present disclosure, a composite closure comprising two vertical stiles, at least two horizontal rails, and a reinforcement plate having openings formed therein is described, wherein the stiles have a channel formed along an inside edge and capable of receiving rails and slat assemblies, and an interior opening shaped to receive the reinforcement plate. In accordance with this embodiment of the present disclosure, the stiles can be fastened to the rails received in the channel by extending a fastener through the interior opening of the stile and the reinforcement plate, and into the rails themselves.

In a further embodiment of the present disclosure, a closure comprising two vertical stiles and at least two horizontal rails is described, wherein at least one of the two horizontal rails comprises a rail extension assembly comprising a rail and a substantially solid extension member which are slidably connected. In accordance with this embodiment of the present disclosure, when the rail extension assembly is located at the top or bottom of the closure and between the two vertical stiles, the height of the closure can be adjusted without adversely affecting the structural integrity or the aesthetic value of the closure.

In a further embodiment of the present disclosure, a composite closure is described, wherein the composite closure comprises two horizontal rails; two vertical stiles each having an interior opening proximate to a channel formed along an inner face of the stile, the channel sized to receive the horizontal rails; one or more reinforcement plates sized to fit within the interior opening in each stile; and a central, planar assembly formed to slidably mate with the channel on each stile; wherein each of the horizontal rails slidably mates with the channel at the top and the bottom of each stile to form a frame, the horizontal rails being attached to the stiles with a fastener that extends from the interior opening in each stile, through the reinforcement plate within the interior opening of each stile, and into the horizontal rails. In accordance with this embodiment, the composite closure may further comprise one or more hinge assemblies, and at least one of the two horizontal rails comprises a solid piece of material (such as a metal rod or bar) that integrally attached to, or integrally formed with, the at least one rail. In further accordance with this aspect of the disclosure, the stiles and the horizontal rails are comprised of a polymeric material, and further comprises at least one cellulose-based material and/or at least one wood substitute material.

In yet another embodiment of the present disclosure, a composite bi-fold closure assembly is described, wherein the assembly comprises two horizontal rails; two vertical stiles each having an interior opening proximate to a channel formed along an inner face of the stile, the channel sized to receive the horizontal rails; one or more reinforcement plates sized to fit within the interior opening in each stile; and a central assembly formed to slidably mate with the channel on each stile, wherein the rails and the stiles are comprised of a composite polymeric material and at least one cellulose-based material, a wood substitute material, or both, and wherein each of the horizontal rails slidably mates with the channel at the top and bottom of each stile to form a frame. The horizontal rails in accordance with this embodiment may be attached to the stiles with a fastener that extends from the interior opening in each stile, through the reinforcement plate within the interior opening of each stile, and into the horizontal rails. In further accord with this embodiment, the cellulose based material and/or the wood substitute material may each be present in the composite material in an amount ranging from about 0.01 wt. % to about 99 wt. %, inclusive. The central, planar assembly may comprise a plurality of louvers, a raised panel, or both.

In another embodiment of the present disclosure, a method is described for assembling a closure comprising one or more horizontal rails, one or more vertical stiles having each having an interior opening proximate to a channel formed along an inner face of the stile, the channel being sized to receive the horizontal rails, a reinforcement plate sized to fit within the interior opening of the stile, and a central planar assembly, the method comprising cutting the two horizontal rails to a first length; cutting the two vertical stiles to a second length; cutting the central planar assembly to the first length; inserting the central planar assembly into the channel formed along an inner face of each stile; inserting a reinforcement plate into the interior opening of the stile; inserting the horizontal rails into the channel on each stile; and fastening the horizontal rails to each stile perpendicularly with a fastener that extends from the interior opening proximate to the channel, through the reinforcement plate, through the stile, and into the horizontal rail, wherein the perpendicularly fastened horizontal rails and vertical stiles form a closure.

In a further embodiment of the present disclosure, an extruded, foamed solid composite bifold door assembly formed in part from foamable plastic consisting of a polymer or polymer resin and cellulose-based material intermixed within the polymer or polymer resin, wherein the composite bifold door assembly is formed by an extrusion process is described, the process comprising the steps of compressing an extrudable composite at a compression stage by passage through an orifice, expanding said composite through a shaper, the shaper having an internal solid surface defining a channel of a predetermined configuration, and solidifying the foamed material to form a solid elongated member of a predetermined profile.

In another embodiment of the present disclosure, a method for assembling a closure comprising one or more horizontal rails, one or more vertical stiles having each having an interior opening proximate to a channel formed along an inner face of the stile, the channel being sized to receive the horizontal rails, a reinforcement plate sized to fit within the interior opening of the stile, and a central planar assembly is described, wherein the method comprises cutting the two horizontal rails to a first length; cutting the two vertical stiles to a second length; cutting the central planar assembly to the first length; inserting the central planar assembly into the channel formed along an inner face of each stile; inserting a reinforcement plate into the interior opening of the stile; inserting the horizontal rails into the channel on each stile; and fastening the horizontal rails to each stile perpendicularly with a fastener that extends from the interior opening proximate to the channel, through the reinforcement plate, through the stile, and into the horizontal rail, wherein the perpendicularly fastened horizontal rails and vertical stiles form a closure.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
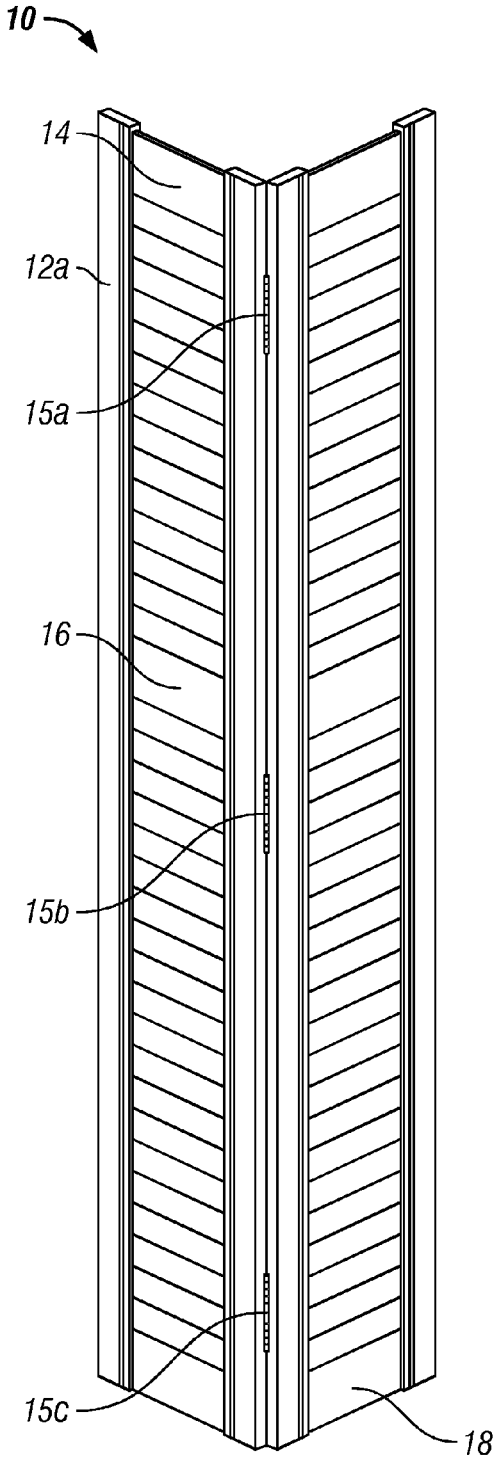
FIG. 1 illustrates a front view of a slatted embodiment of a bi-fold closure assembly in accordance with an aspect of the present invention.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DEFINITIONS

The following definitions are provided in order to aid those skilled in the art in understanding the detailed description of the present invention.

As used herein, the term "closure" is meant to refer to any of a number of movable structures capable of being used to close off an entrance, such as to a room, a closet, or a building, typically consisting of a panel or similar structure that swings on hinges or that slides or rotates.

The term "wood composite", as used herein, means a composition comprising at least one polymer component and at least one cellulose-based component, at least one wood substitute component, or both, such that the overall composite product is primarily polymeric, but has lighter weight characteristics than products which contain no cellulose-based or wood substitute components.

As used herein, the term "cellulose-based component" refers to a material comprising, cellulose, a complex carbohydrate that is the basic structure component of the plant cell wall of green terrestrial and marine plants as well as produced by several bacteria, animals and fungi, and both natural and synthetic derivatives of cellulose, polymorphs thereof, and ether- and ester-type cellulose derivatives, such as described and (Wiley-Interscience).

As used herein, the term "wood substitute component" refers to those materials which are known in the art to be suitable for use as substitutes for wood flour and wood dust fillers, wood dust, wood chips, and the like, especially in the context of polymeric and thermoplastic composite materials.

DETAILED DESCRIPTION OF THE INVENTION

One or more illustrative embodiments incorporating the invention disclosed herein are presented below. Not all features of an actual implementation are described or shown in this application for the sake of clarity. It is understood that in the development of an actual embodiment incorporating the present invention, numerous implementation-specific decisions must be made to achieve the developer's goals, such as compliance with system-related, business-related, government-related and other constraints, which vary by implementation and from time to time. While a developer's efforts might be complex and time-consuming, such efforts would be, nevertheless, a routine undertaking for those of ordinary skill the art having benefit of this disclosure.

It should be noted that in the descriptions of the drawings, the same components will be provided with the same reference numerals and duplicate explanation for the same components is omitted. The ratios of sizes appearing in the various figures are not always coincident with the description. Additionally, this description is intended to be read in connection with the accompanying drawings, which are to be considered part of the entire written description of this invention. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" refers to such an attachment, coupling or connection that allows the pertinent structures to operate as intended by virtue of that relationship.

Further, there are other features inherent within the instantly-described products and compositions that will be recognized by those of skill in the art. For example, based on the compositions of the closures described herein, it should be noted that the instantly described and claimed closures are generally fire-resistant, or fire-retardant, in that due to their polymer-based compositions, such as PVC-based compositions, they can be inherently difficult to ignite and typically stop burning once the source of heat is removed. Depending upon the specific closure composition, many of the PVC—and other polymer-based closure compositions described herein may perform better in terms of lower combustibility, flammability, flame propagation, heat release, lower acid emission, and lower smoke generation than their counter-part wood closures.

Similarly, it will be recognized that that the presently disclosed closures and their methods of manufacture offer a number of additional advantages over the use of traditional wood or metal alternatives, as suggested above. For example, typical solid wood closures are either cost-prohibitive in nature due to material and manufacturing costs, or are unattractive due to the inherent physical characteristics and flaws (e.g., knots) of the wood itself. It is well known that wood over 18 inches in length is increasingly prone to swelling, warping, and bowing, which can lead to a closure (such as a bi-fold door or similar closure) no longer functioning properly. The presently described products offer an economical, often environmentally-friendly option to the use of wood and wood-based products (e.g., MDF or chipboard) for a variety of aesthetically-pleasing closures, including entrance doors, bi-fold closet doors, or similar closures.

Figure 2:
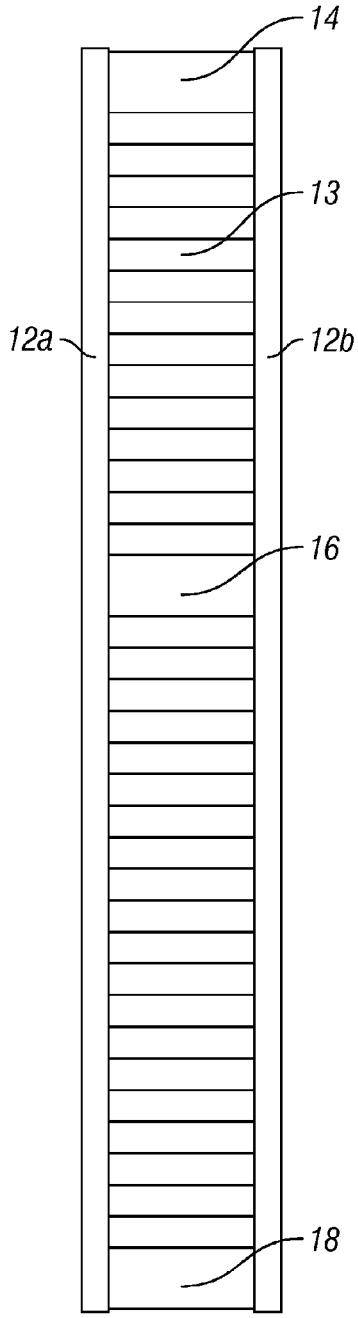
FIG. 2 illustrates a front view of a single panel of the closure assembly of FIG. 1.

Turning now to the figures, FIG. 1 illustrates a bi-fold closure assembly 10 in accordance with aspects of the present invention, while FIG. 2 illustrates a single panel of the closure of FIG. 1. As detailed herein, while bi-fold doors are detailed herein with respect to specific applications, it will be recognized by those of skill in the art that the features of the composite bi-fold doors may be applied to other composite closures, such as entry doors, cafe-style doors, shutters, and similar closures. As generally shown in FIG. 1, each panel of the closure assembly 10 comprises two side stiles, 12*a* and 12*b*, top and bottom rails 14 and 18, respectively, and optionally and intermediate middle rail 16, which can be included so as to provide extra stability for the door and simultaneously provide a means for attaching an opening mechanism, such as a knob or handle. As illustrated in FIG. 2, the closure 10 is generally a rectangular-shaped closure formed by the side stiles 12*a* and 12*b*, and top and bottom rails 14 and 18. Intermediate between the top and middle rails 14 and 16, and the middle and bottom rails 16 and 18, are slats 13 which typically extend across the frame interior from one vertical stile 12*a* to the other vertical stile 12*b*. Slats 13 are typically received in a slat retainer (not shown), such as described in U.S. Patent Publication No. 2004/0068936, incorporated herein by reference in its entirety. With regard to the slats 13, and the associated slat retainer, while closures 10 illustrated herein are shown having slats mounted within a slat retainer, the present invention is not limited to substantially planar center panels comprising slats alone. Accordingly, the present invention is meant to include closures wherein all of the center panels can be slatted, or one is slatted while the other(s) are substantially solid panels, or, all (or as in FIGS. 1 and 2, both) central panels are solid panels. In the event that a substantially solid central panel is included in the closure assembly, such a substantially solid (non-slatted) central panel may have a formed face, or outward surface, on one or both sides, as will be described in more detail below with regard to manufacturing methods. The two (or more) closure assemblies are foldably connected via hinges 15*a*, 15*b*, and 15*c*, which can be any suitable hinge, including a piano-type hinge as will be described in more detail below, and can vary in number and placement as necessary depending upon the vertical height of the closure, the end use of the closure, and aesthetics.

While the bi-fold door closure assembly 10 in FIG. 1 and FIG. 2 is illustrated to have a top rail 14, a bottom rail 16, and two mid-rails 16, those of skill in the art will recognize that this is exemplary only, and is not meant to be limiting to the closure assemblies of the present disclosure. For example, the closure of FIGS. 1 and 2 is illustrated to be a standard, 96-inch bi-fold closure, and includes two optional mid-rails 16 for the purpose of enhancing the strength and sturdiness of the closure itself However, the inclusion of mid-rails, or two mid-rails, is not to be meant as limiting. Rather, closures in accordance with the present disclosure may comprise no (0) midrails, or may optionally and equally acceptably comprise one or more mid-rails, the number of which will often be determined by the size (e.g., height) of the closure itself, and/or the purpose the closure is manufactured for; that is, the number of mid-rails may differ substantially for a closure used as an interior, closet door in a domestic dwelling compared to the number of mid-rails that may be optimal for use in a closure to be used as an exterior closure, or door, such as a main entry door.

Figure 3:
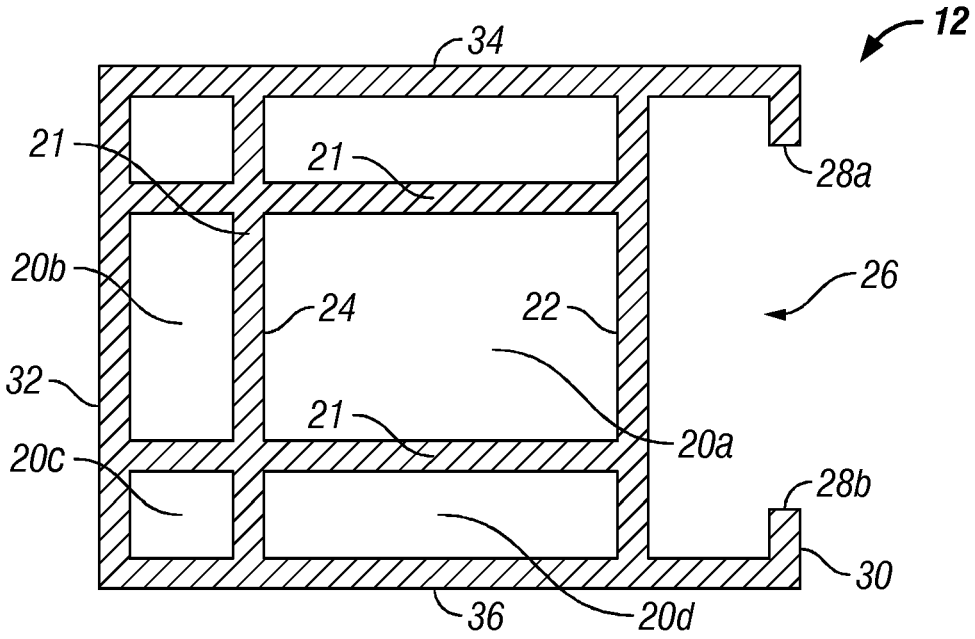
FIG. 3 illustrates a top view of a cross section of a stile as shown in FIG.

Further details of the assembly strengthening embodiments of the present invention will now be described. FIG. 3 illustrates a top, cross-sectional view of a side stile 12*a* in accordance with the present invention. As shown therein, stile 12*a* is substantially rectangular in shape, comprising inside face 30, outside face 32, and front and back faces 34 and 36. Faces 34 and 36 are substantially parallel to each other and spaced apart in such a manner that they are substantially perpendicular to inside face 30 and outside face 32. Additionally, faces 34 and 36 can be substantially identical, allowing their orientation to be interchangeable. As further shown in FIG. 3, stile 12*a* comprises a plurality of shaped, interior openings 20*a*-20*d*, which are formed by support ribs 21, which provide interior strength for stile 12*a*. Stile 12*a* further comprises inwardly-facing tabs 28*a* and 28*b* at inside face 30, which act to form a groove 26 that extends substantially the entire length of the interior face of stile 12*a*. In accordance with aspects of the present invention, stiles 12*a* and 12*b* can be manufactured by an extrusion process. In further accordance with aspects of the present disclosure, while not illustrated in FIG. 3, it is envisioned that interior opening 20*a* may optionally include one or more support ribs, oriented in an appropriate manner, so as to provide additional structural support to the stiles 12*a* and 12*b*. For example, and in accordance with this aspect, opening 20*a* may contain two support ribs oriented with regard to each other such that they form an "X" when viewed from the top.

Figure 4:
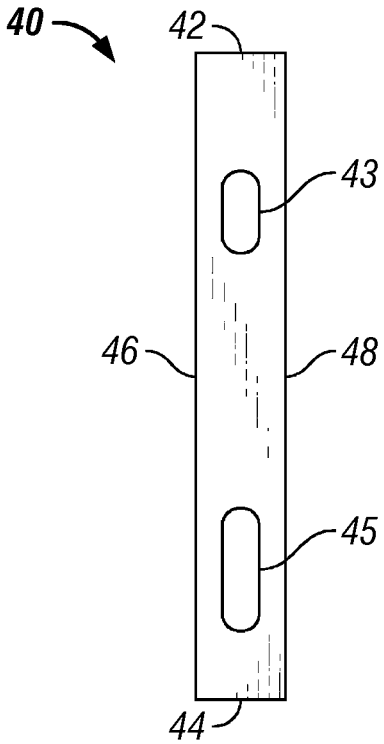
FIG. 4 illustrates a front view of a reinforcement member in accordance with an embodiment of the present invention.

FIG. 4 illustrates a reinforcement plate 40 for use in accordance with aspects of the present invention, in order to strengthen the assembly of closures 10. More specifically, in order to overcome potential weakening of the construction of the stiles or horizontal rails of the closures described herein due to over tightening of the fasteners connecting them as the fasteners pass through the typically polymeric material, one or more reinforcement plates 40 can be utilized in the methods of constructing these closures. Reinforcement plate 40 is preferably a rectangular, substantially flat stamped plate made of a material that is not subject to deformation, such as steel. Other suitable materials and metals are known in the art, and can be used in the manufacture of reinforcement plates for use as described herein. Rectangular-shaped plate 40 comprises spaced apart top edge 42 and a bottom edge 44, and substantially parallel and spaced apart longitudinal edges 46 and 48 interconnecting edges 42 and 44. Reinforcement plate 40 further comprises at least two openings, 43 and 45. Optionally, and in accordance with the present invention, reinforcement plate 40 can comprise a single, longitudinally shaped opening which can allow for vertical adjustment of the plate during placement within stile 12*a*, as will be described in more detail below. Reinforcement plate 40 can be shaped such that it is substantially similar in size to the end of the horizontal rails, such as top rail 14, in which instance a separate plate 40 can be inserted within the stile at the appropriate location prior to attachment of the rail to the stile, as will be discussed below. Optionally, and in accordance with aspects of the present invention, reinforcement plate 40 can be formed of one (or more) pieces of metal, and of a size and length such that it extends longitudinally substantially the same entire distance of the length of the stiles of the closure assembly.

Figure 5:
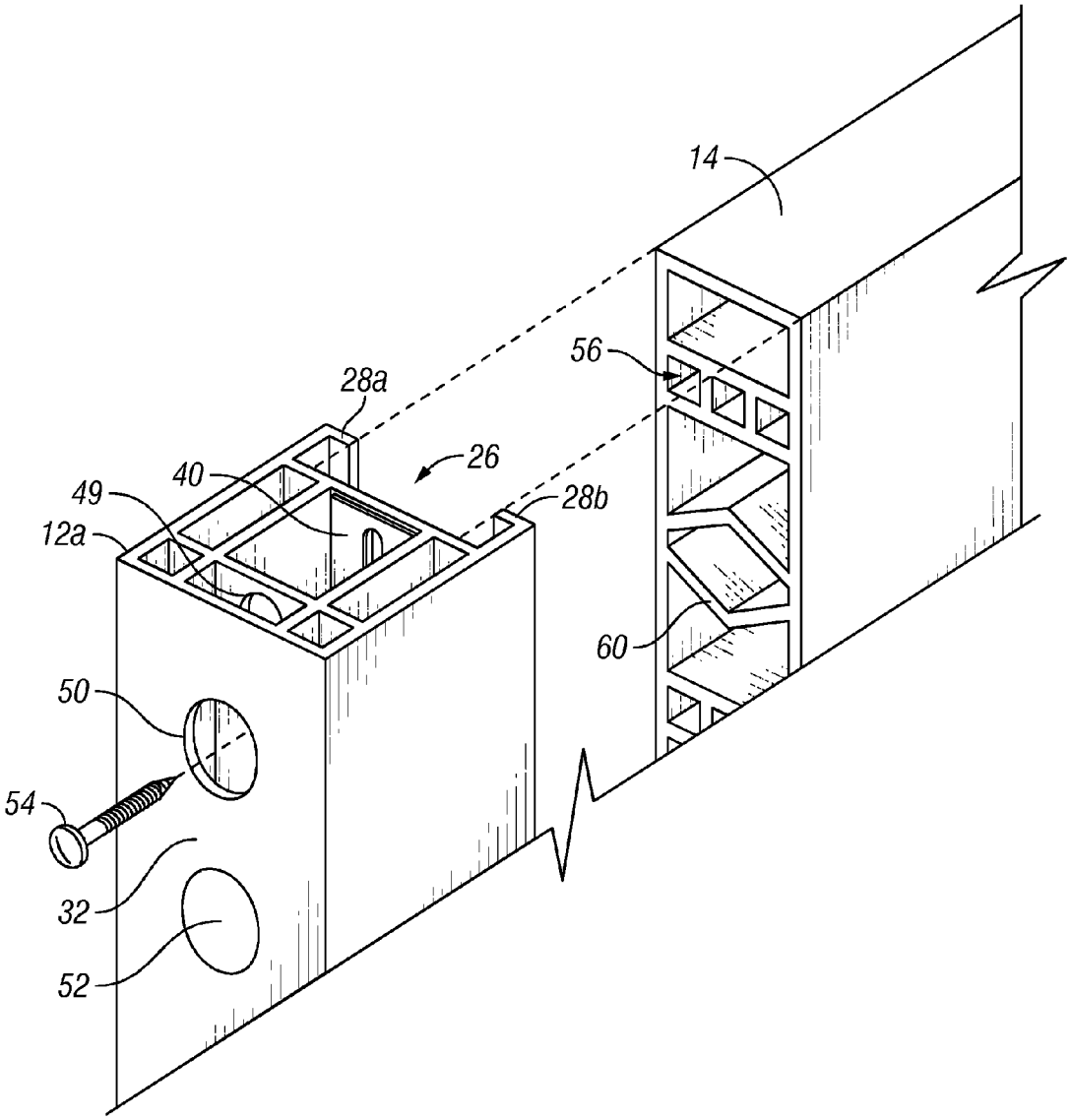
FIG. 5 illustrates a perspective view of the assembly of a panel of a closure assembly in accordance with an embodiment of the present invention.

Turning now to FIG. 5, a perspective view of the assembly of a panel of a closure assembly in accordance with an aspect of the present invention is illustrated, further showing the inclusion of reinforcement plate 40. As illustrated therein, rail 14 can be slidably inserted into groove 26 formed by inward tabs 28*a* and 28*b* on the inside face 30 of stile 12*a*. As can be seen in the view of this figure, rail 14 can comprise a number of strengthening structures within the interior of the rail itself, including securing vanes 56, central support vane 60, or both.

With continued reference to FIG. 5, following insertion of rail 14 into groove 26, reinforcement plate 40 can be slidably inserted into interior opening 20*a* within stile 12*a* and vertically adjusted such that holes 23 and 25 substantially align with pre-formed holes (not shown) on the inner wall of interior opening 20*a*. Optionally, such holes can be formed first by an appropriate drilling tool via bore 50 on outside face 32 of stile 12*a*, which extends through ribs 21 and through both interior openings 20*a* and 20*b*. Following alignment of plate 40 with the holes in stile 12*a*, rail 14 is adjusted vertically as necessary such that securing vanes 56 are aligned with holes 23 and 25 in plate 40. Rail 14 is then secured to stile 12*a* using an appropriate fastener 54, such as a screw, nail, bolt, or other appropriate means, which is inserted through bore 50 and into interior opening 20*a* of stile 12*a* by way of opening 49 (see FIG. 6). Bore 50 can then be covered using plug 52, so as to maintain the appearance of the outside face 32 of stile 12*a*.

Figure 6:
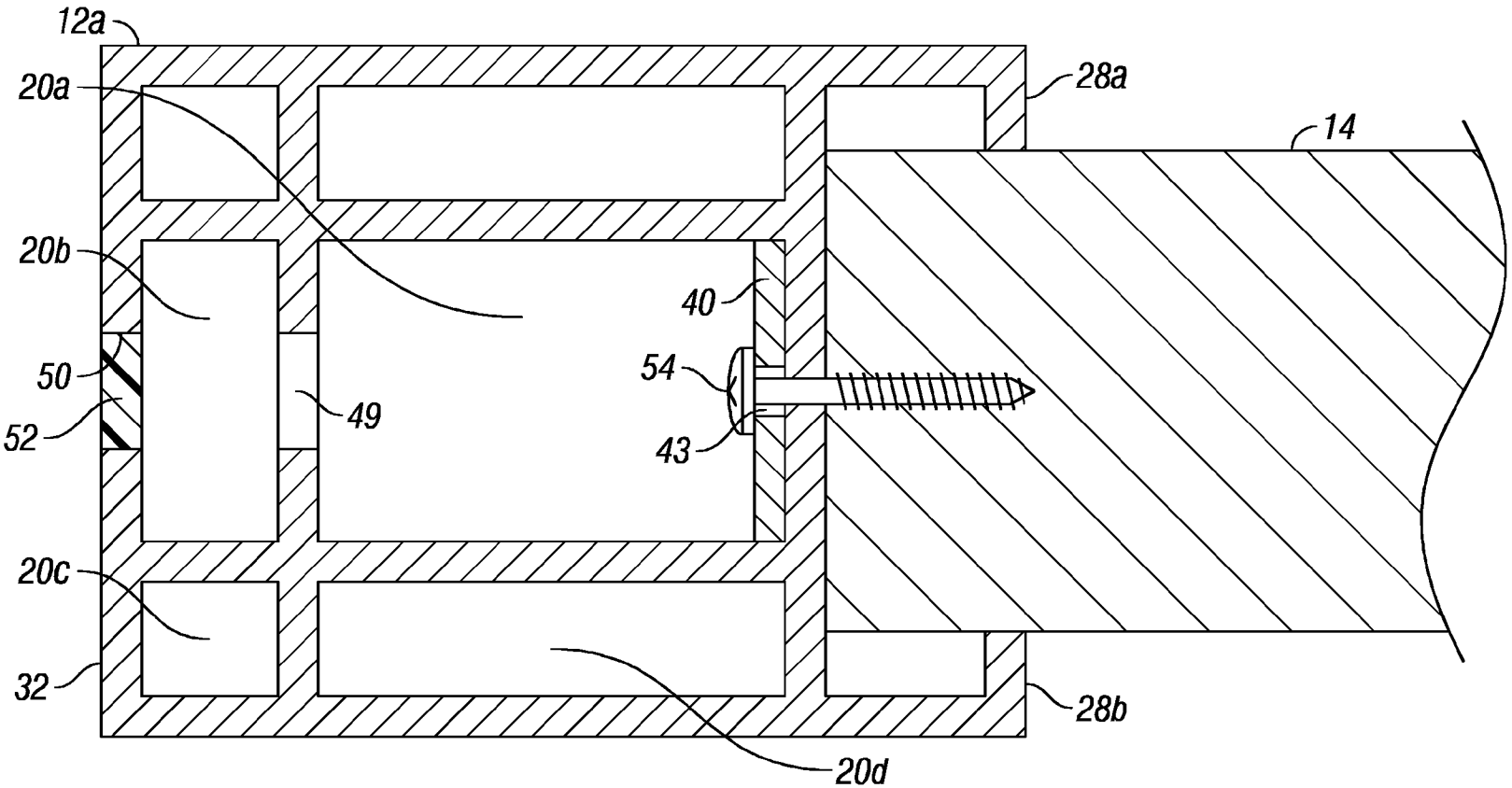
FIG. 6 illustrates a cross-sectional view of the assembly of FIG. 5.

FIG. 6 illustrates a cross-sectional view of the assembly of FIG. 5, taken along line 1-1. As illustrated therein, fastener 54 extends through reinforcement plate 40, fastener opening 43 in the inside face of groove 26 of stile 12*a*, and into rail 14, wherein the fastener preferably engages (e.g., threadably engages) at least a portion of at least two of the sides of securing vanes 56 within rail 14. As further illustrated therein, plug 52 closes bore 50 so as to form a substantially smooth, finished surface on outside face 32 of stile 12*a*.

Figure 7A:
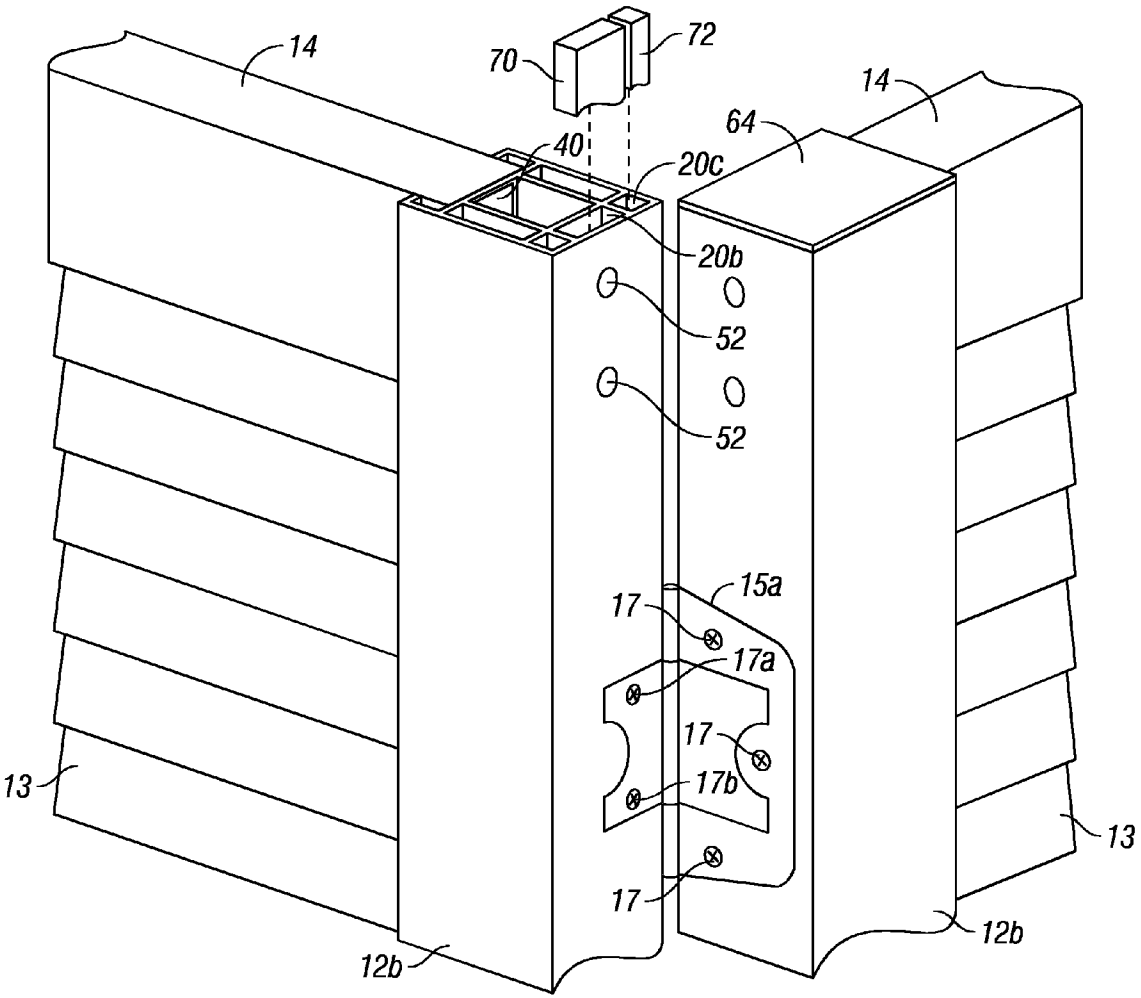
FIG. 7A illustrates a perspective front view of a top portion of a closure in accordance with an embodiment of the present invention.

A further embodiment of the present invention is illustrated in FIG. 7A, and provides additional strength for the attachment of hinges 15 on a closure of the present invention when they are desired, such as for the construction of a bi-fold door. As shown therein, in the instance that two closures are to be hingeably connected, such as in the instance of a bi-fold door, hinges 15*a* are fastened to the outside face 32 of stiles 12*b* at an appropriate location, using fasteners 17. In order to provide added strength to the assembly of the closures, and simultaneously minimize the chance for hinge pull-out or tear out, which could ruin the utility of the entire closure assembly, insertable supports 70 and 72 can be included in the closures. Typically, such supports can be made of the same or a similar material to the rest of the closure assembly, and can be of any desired length.

For example, insertable supports 70 and 72 can be sized such that they are substantially the vertical length of the hinge to be attached. Alternatively, and equally acceptable, insertable supports 70 and 72 can also be sized to be substantially the same length as the vertical length of stiles 12*a* and 12*b*.

Figure 7B:
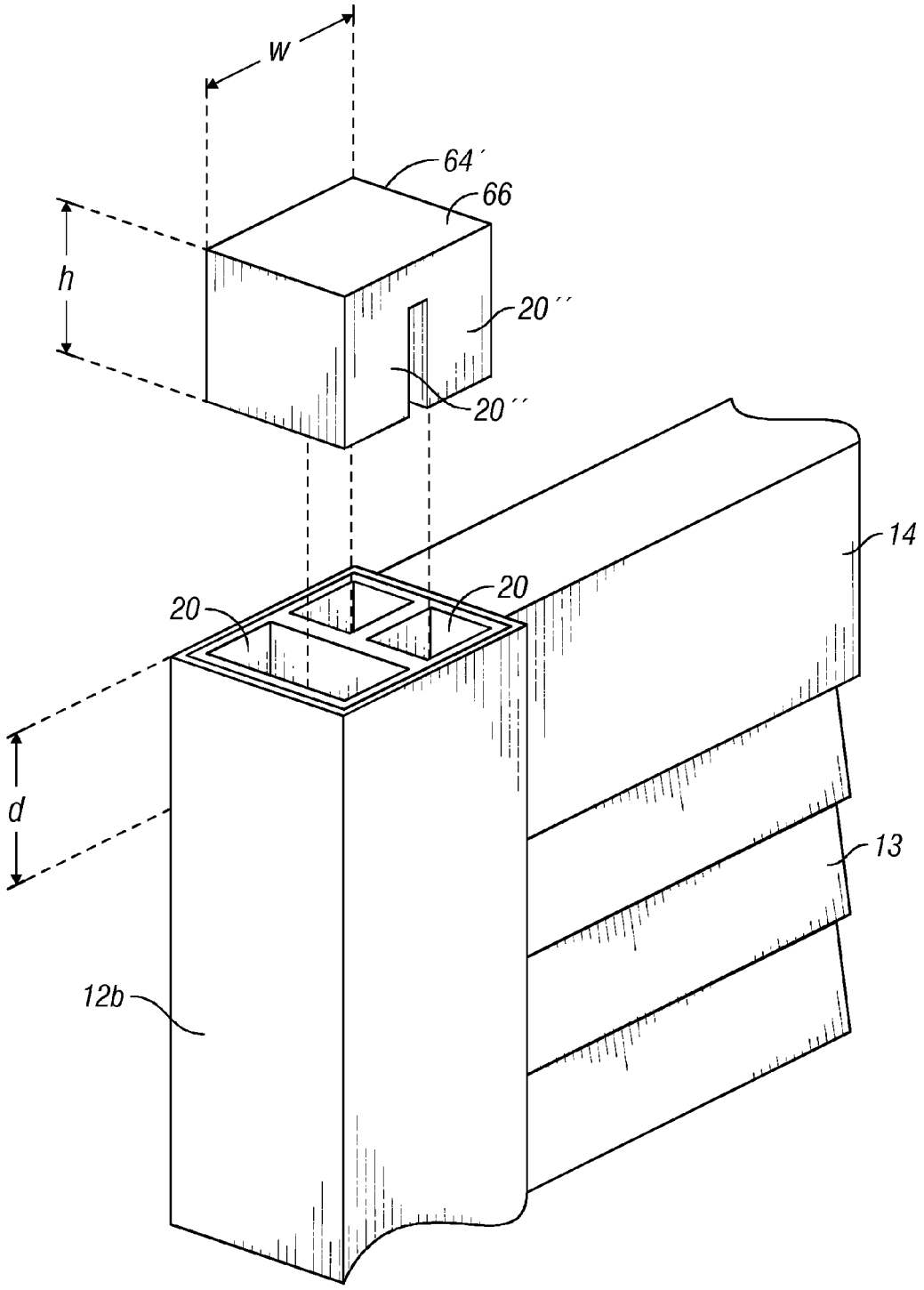
FIG. 7B illustrates a further embodiment of aspects of the present disclosure, detailing an end-cap of FIG. 7A.

Further referencing FIG. 7A, top portion of the stile 12*a*/12*b* may be in the form of a "cap" 64 which rests upon the top and bottom of the stile. Optionally, and equally acceptable, referring to FIG. 7B, cap 64' may be a flush-mounted cap, having a thickness such that it extends a predetermined distance into the interior spaces of the stiles, and is held in place by either mechanical fastening means, or by shaped tabs (not shown) spaced away from the top 66 of cap 64' and which lockably engage seats (not shown) formed within the interior of the stiles 12*b*. A further optional variation of this aspect of the present disclosure is illustrated in FIG. 7B, wherein end cap 64' may be substantially solid and have a thickness h and a width w such that it extends a distance d (e.g., 2-3 inches) into stile 12*b*, and fits snugly into one or more openings 20 within stile 12*b* with mating legs 20" of cap 64', whereinafter end cap 64' may be held in place by any number of mechanical or chemical attachment means, such as by way of a suitable adhesive. In accordance with this aspect, when the height of the closure assembly is adjusted on site by cutting a portion of the bottom or top of the door off, as will be detailed more below, a solid portion of the cap also remains and aids in the aesthetics of the closure itself after cutting, when viewed from the top or bottom. Such substantially solid caps may be retained in place by any acceptable retaining means, such as with chemical means (glues) or mechanical means (fasteners, such as screws).

Figure 8:
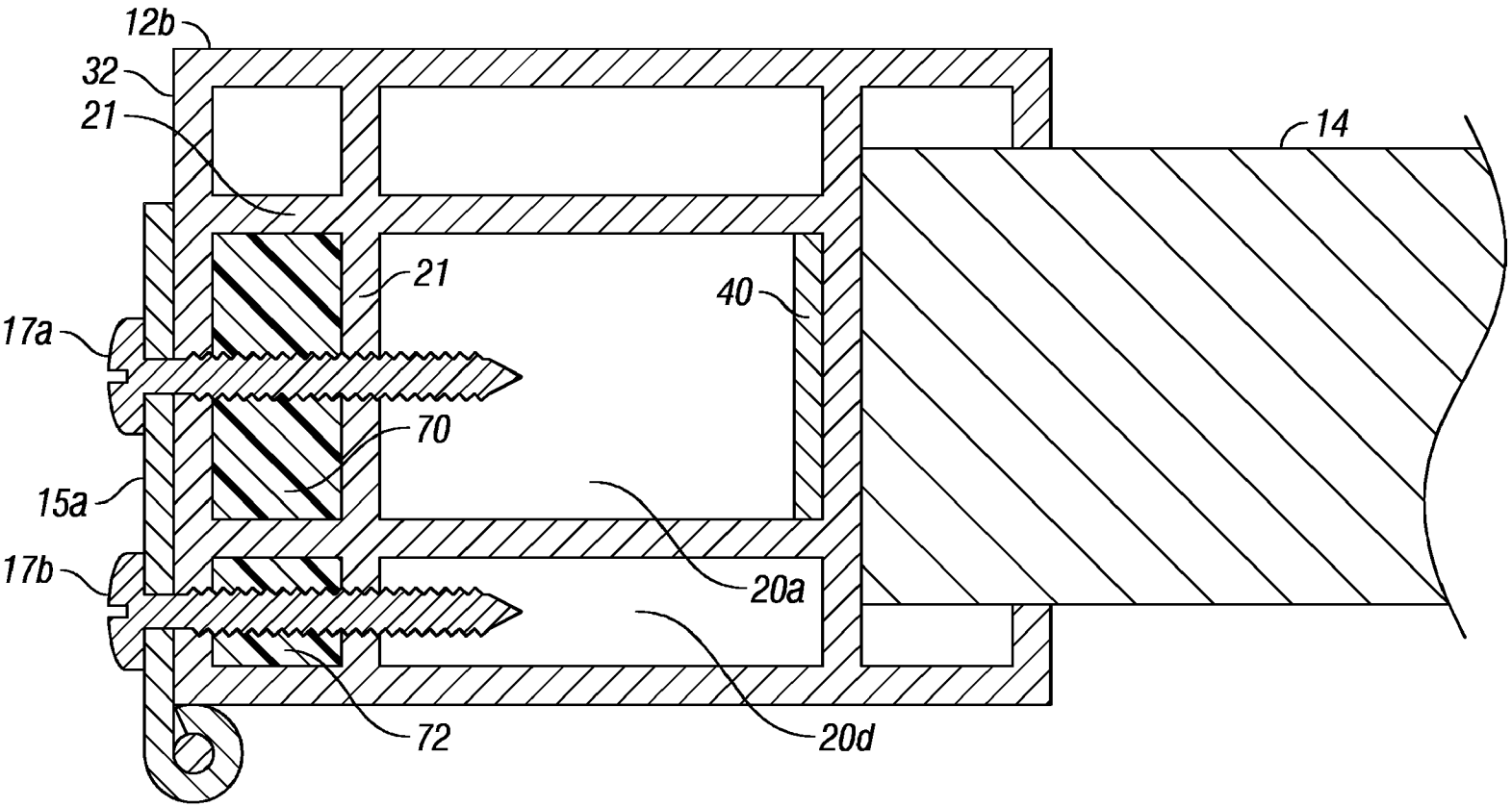
FIG. 8 illustrates a cross-sectional view of the embodiment of FIG. 7.

FIG. 8 illustrates a cross-sectional view of the assembly of FIG. 7A, taken along line 2-2. As illustrated therein, hinge 15*a* can be secured to outside face 32 of stile 12*b* using fasteners 17*a* and 17*b*, which can be any suitable fastener, such as screws, nails, bolts, and similar threaded fasteners. Prior to securing hinge 15*a*, rectangular insertable support 70 can be inserted into interior opening 20*b* formed by ribs 21, and insertable support 72 can be inserted into interior opening 20*c* formed by ribs 21. Following insertion of supports 70 and 72, hinge 15*a* can be secured to stile 12*b* by threadably inserting fasteners 17*a* and 17*b* through the outside face 32 and supports 70 and 72, respectively, such that fasteners 17*a* and 17*b* extend at least partially into interior openings 20*a* and 20*d*. In this manner, hinge 15*a* will have an extended use life, and will have significantly reduced changes of becoming separated from stile 12*b*. Optionally, and in accordance with this aspect of the present invention, in lieu of using insertable supports 70 and 72, when stiles 12*a* and 12*b* are manufactured, they can be manufactured without interior openings 20*b*, 20*c*, and the other, similar openings, as necessary, such that the interior openings 20*b* and 20*c* illustrated in FIG. 7A would be a solid material, substantially the same material as the rest of the stile. In example, during the manufacture of stiles 12*a* and 12*b*, they can be extruded such that only interior openings 20*a* and 20*d* are present. Other variations of such extruded products are also contemplated herein. Such an embodiment can eliminate the need for extra manufacturing and/or assembly steps.

Figure 9:
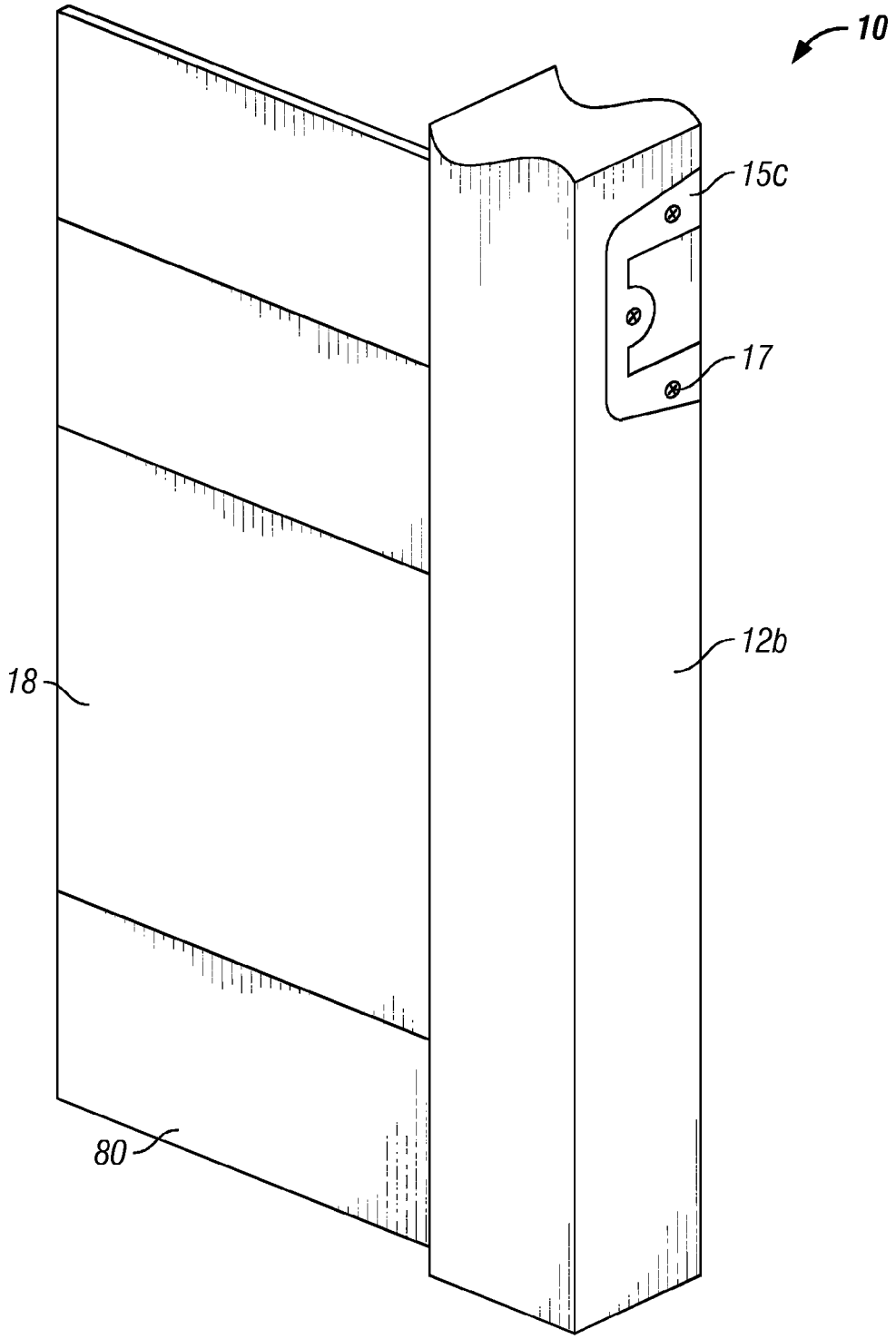
FIG. 9 illustrates a perspective view of an alternative embodiment of the present invention.
Figure 10:
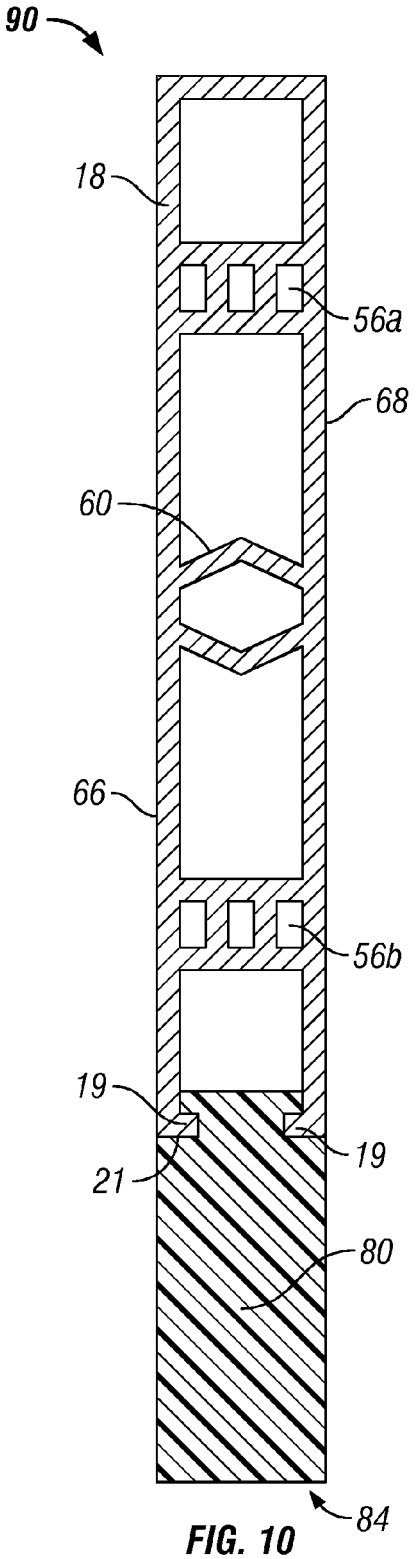
FIG. 10 illustrates a cross-sectional view of the embodiment of FIG. 9.
Figure 11:
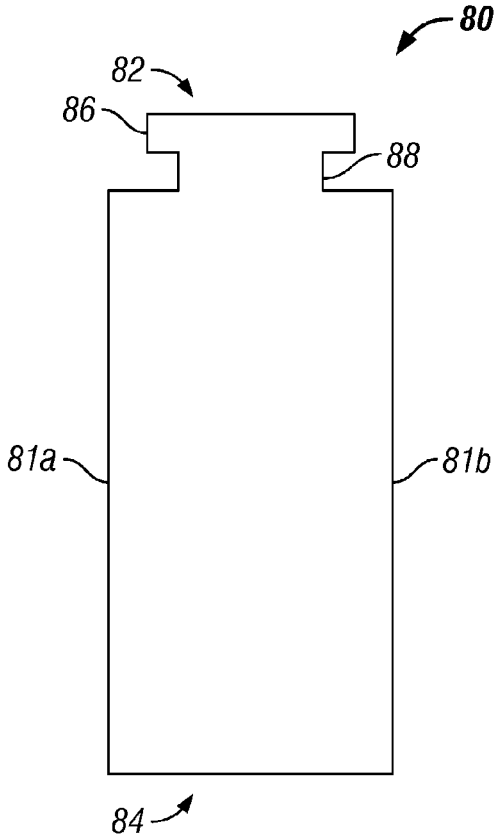
FIG. 11 illustrates a detailed cross-section of a portion of the embodiment of FIG. 10.

While hinge 15*a*, illustrated in association with an exemplary bi-fold door type closure, is shown to be a standard concealed, non-mortise hinge, this is by no means meant to be limiting. Hinges suitable for use with bi-fold door type closures of the present disclosure may include, without limitation, concealed non-mortise hinges, non-concealed non-mortise hinges, butt-type hinges, cylinder hinges, spring-loaded hinges, continuous hinges (a.k.a. "piano-type" hinges), partial wrap hinges, full-wrap hinges, semi-concealed hinges, 3-way hinges, knife hinges, and combinations of two or more of these hinges, which may be the same or different. Additionally, as will be recognized by those of skill in the art, the number, size, and type best suited for the individual closure types will vary, depending on the size and purpose of the closure assembly itself In a further embodiment of the present invention, closures such as bi-fold doors 10 can have an assembly as illustrated in FIGS. 9-11, wherein the closures further comprise a rail extension 80 attached to bottom rail 18 during manufacture of the closure itself Extension 80 is incorporated into the closure to enable the closure to be adjusted by the installer for height so as to be "custom-fit" to the opening the closure is to be mounted in, while maintaining the aesthetics of the closure after such an adjustment. For example, such a feature is useful in fitting a closure in accordance with the present invention into a non-standard doorway or opening, or into an opening wherein the floor is uneven, requiring the bottom of the closure 10 to be cut in order to fit and function smoothly within the opening. With standard metal or composite closure assemblies which are made of plastics, polymers, or the like, if the bottom rail is cut with a saw or other similar cutting apparatus in order to adjust the height of the closure to fit into an opening, the aesthetics of the closure are lost, and oftentimes the structural integrity of the closure itself is compromised, which is undesirable. The inclusion of rail extension 80 addresses this problem, and allows the closure, such as a bi-fold door or standard room entry door, to be cut to a specific height as necessary in order to fit into non-standard openings. That is, in the instance wherein a customized, finished door opening for a closet is 24" wide.times.781/4" tall, and the standard bi-fold door is 233/4" wide.times.791/4" tall, the bottom of the bi-fold door can be cut using a table saw or circular saw, for example, in order to remove the appropriate amount of material (e.g., about ½-inch) so as to allow the door to fit, while still allowing the bi-fold door to remain aesthetically pleasing along the bottom edge.

Turning now to FIG. 9, there is illustrated a partial view of the lower section of a single closure assembly 10, showing in perspective how the lower section of the closure can appear when bottom rail 18 has a rail extension attached to its bottom end. FIG. 10, which is a partial view of the assembly of FIG. 9 taken along line 3-3, illustrates in cross-section the connection of rail extension 80 to bottom rail 18.

FIG. 11 illustrates the details of rail extension 80. Extension 80 is preferably manufactured of a solid material, so as to not be subject to splitting, cracking, or tear-out when it is cut during size adjustment of the closure 10. Rail extension 80 is a generally rectangular, longitudinal section of material, having a top edge 82, a bottom edge 84, and parallel, spaced apart front and back sides 81*a* and 81*b*, respectively. The top edge 82 of extension 80 further comprises a shaped lip 86 on both the front and back faces, and an integrally formed channel, or notch, 88 intermediate between the shaped lip 86 at the top edge 82 and the front and back sides 81*a* and 81*b*. Rail extension 80 can be manufactured from any acceptable material as discussed below, preferably of a material that is similar to or the same as the material used to manufacture the rest of the door. It can be formed by any number of acceptable processes, including extrusion, mold-forming, and the like, and the lip 86 and channel 88 can be formed during such an extrusion or mold-forming process, or in a separate step using an appropriate forming tool, such as a CNC router or the like.

Returning to FIG. 10, it can be seen that bottom rail 18, for use with rail extension 80 to form the extension assembly shown in FIG. 9, is a modified version of the standard bottom rail used in closures in accordance with other embodiments of the present invention. That is, as shown in the cross-section, in addition to securing vanes 56*a* and 56*b*, and support vane 60, rail 18 also comprises inwardly facing bottom tabs 19 at its lower edge 21. Tabs 19, each projecting inward from the front and back faces 66 and 68, respectively, act to slidably engage channel 88 in rail extension 80, so that extension 80 cleanly connects to the bottom edge of rail 18. Extension 80 can be attached to bottom rail 18 by any number of acceptable methods, including the use of fastening devices such as screws or nails, or by the use of a suitable adhesive, the types of which are known to those of skill in the art. In the instance that an adhesive is used to secure rail extension 80 to bottom rail 18, it is preferable that during manufacture, the appropriate adhesive is first applied to the edges of inwardly projecting tabs 19 of rail 18. Optionally, the adhesive can also be applied within channel 88 of extension 80 prior to being slidably engaged with notches 19 on the lower edge of rail 18. Once the rail extension 80 has been slidably engaged with bottom rail 18, and fastened as appropriate, the rail assembly 90 comprising rail 18 and extension 80 can be used in the assembly of the closure in the standard manner, as described in more detail below.

In accordance with the embodiment of the invention illustrated in FIGS. 9-11, while the rail assembly 90 has been described as comprising a separate extension 80 and rail 18 which are fastened together in an appropriate manner so as to create assembly 90, it is not meant to be limited by such an attachment as illustrated. For example, bottom rail 18 can be integrally formed, (e.g., by extrusion or a similar process) to be of one piece having substantially the same profile as assembly 90, without the need for two (or more) separate components that must be assembled prior to assembly of the closure itself. Similarly assembly 90 as described in FIGS. 9-11 need not be limited to the tab and channel assembly illustrated, but can also contemplate dovetail-type joining, tongue-and-groove type joining, and other joinery methods suitable for use with such materials as described herein.

Figure 12:
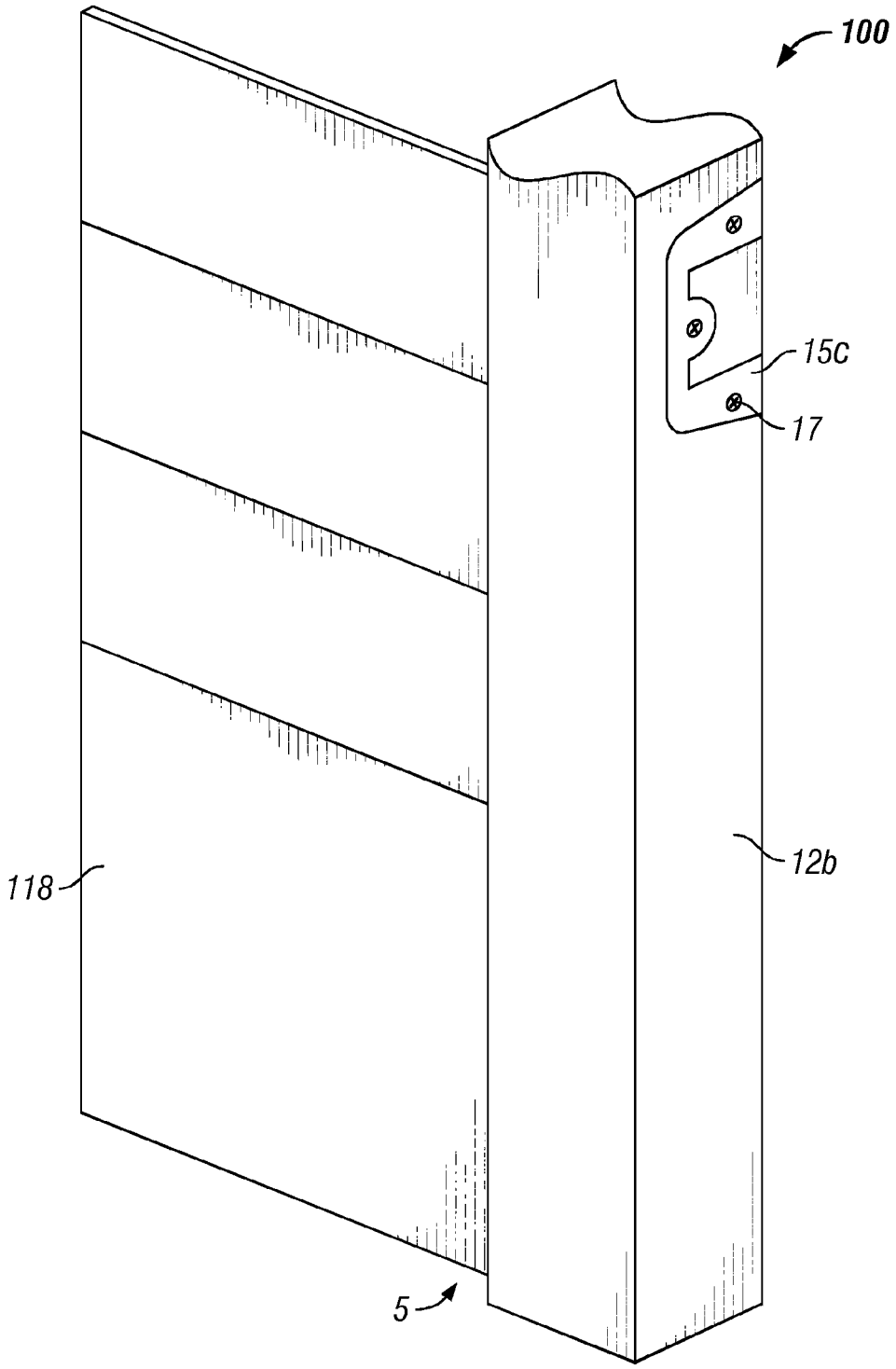
FIG. 12 illustrates a perspective view of an embodiment of the present invention.
Figure 14:
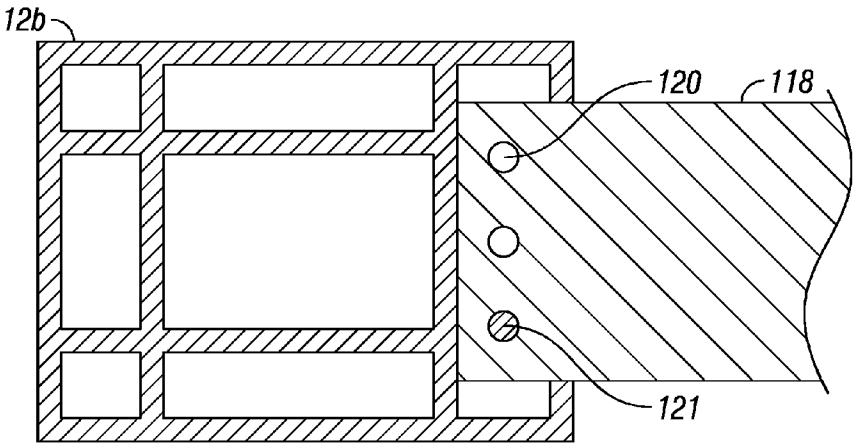
FIG. 14 illustrates a bottom view of the embodiment of FIG. 12.
Figure 13:
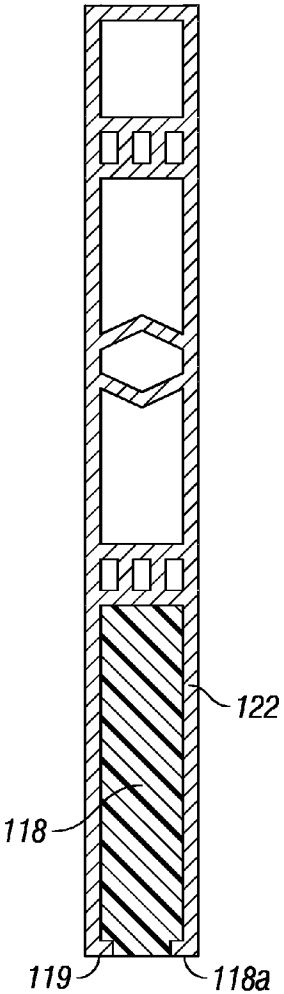
FIG. 13 illustrates a cross-sectional view of the embodiment of FIG. 12.

FIGS. 12-14 illustrate a further embodiment of the present disclosure, wherein one or more of the rails, preferably the top or bottom rail, is substantially one solid piece of wood composite material, so as to further enhance height adjustment of the closure product as necessary. Turning to FIG. 12, a partial view of a lower closure assembly 100 of a bi-fold closure assembly as generally shown in FIGS. 1 and 2 is illustrated, showing this embodiment.

FIG. 13, which is a partial view of the assembly of FIG. 12 taken along line 4-4, illustrates in cross-section the connection of solid bottom rail 118 to the rest of the closure assembly. As illustrated therein, rail 118 comprises inner, substantially solid portion 118*a*, which fills the entirety of the void, or channel 122 created by the lower end of rail portion AA. Channel tabs 119 may be optionally included, as appropriate. In a typical method of manufacturing, the rail can be manufactured as one solid piece, or rail portion 118*a* may be first manufactured as appropriate, and then substantially solid rail 118*a* may be slidably inserted into channel 122, using any appropriate insertion means. It should be mentioned that while this figure illustrates the use of this embodiment at the bottom of a closure, such as a bi-fold door, it could also reasonably be incorporated into the top portion as well, should it be necessary or appropriate.

FIG. 14 illustrates a cross-sectional view of the assembly of FIG. 12, as viewed along line 5, showing one manner in which substantially solid rail 118 can be connected to the side stile 12*b* of the closure. As illustrated therein, due to the fact that substantially solid rail 118 is included so that the overall height of the closure can be cut with an appropriate cutting means so as to adjust the closure to the appropriate height, it is preferred that rail 118 be connected to stile 12*b* by way of substantially solid dowels or pegs 119, which may be inserted through pre-drilled or pre-formed, similarly-sized holes 120.

Figure 15A:
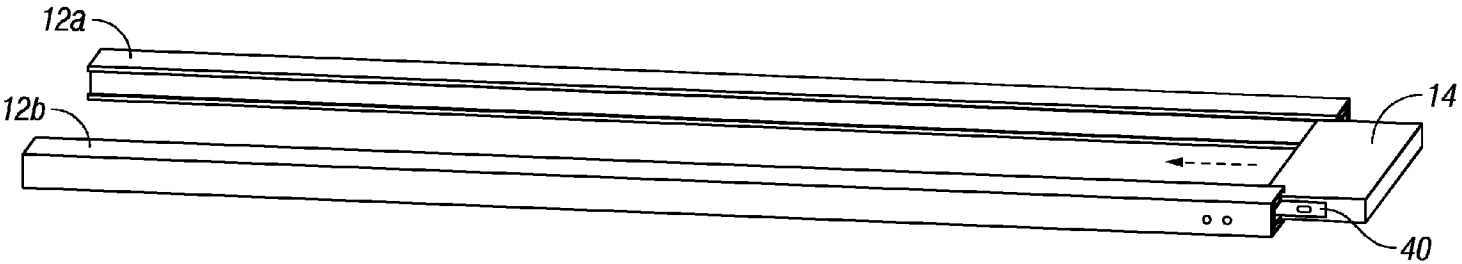
FIGS. 15A-15F illustrate a method of assembly of closures in accordance with aspects of the present invention.

In accordance with aspects of the present invention, a method of assembly of the bi-fold doors as described herein is illustrated in FIGS. 15A-15F. As shown in FIG. 15A, in beginning the assembly, top rail 14 is inserted into channel 20 within stiles 12*a* and 12*b* to form three sides of the closure. Reinforcement plate 40 is then inserted into interior opening 20*a* within the stiles 12*a* and 12*b*, and the top rail 14 is fastened to the stiles using a mechanical fastener, as described previously. Optionally, and as described above, reinforcement plate 40 can be of a length such that it extends substantially the entire length of stiles 12*a* and 12*b*, wherein plate 40 can then be inserted within interior opening 20*a* of both stiles, and the rails fastened thereafter.

Figure 15B:
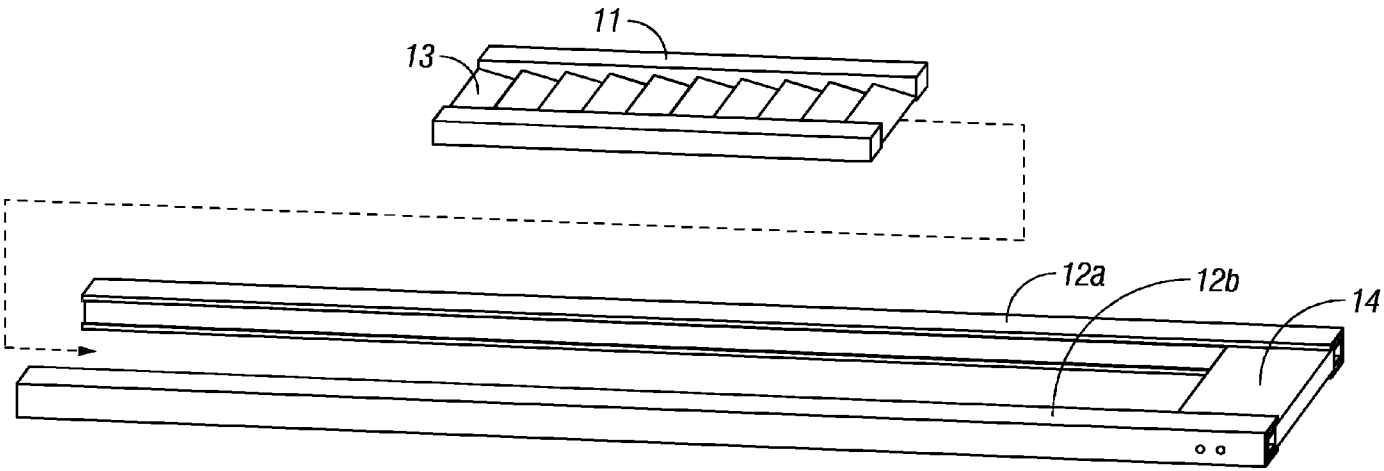
Figure 15C:
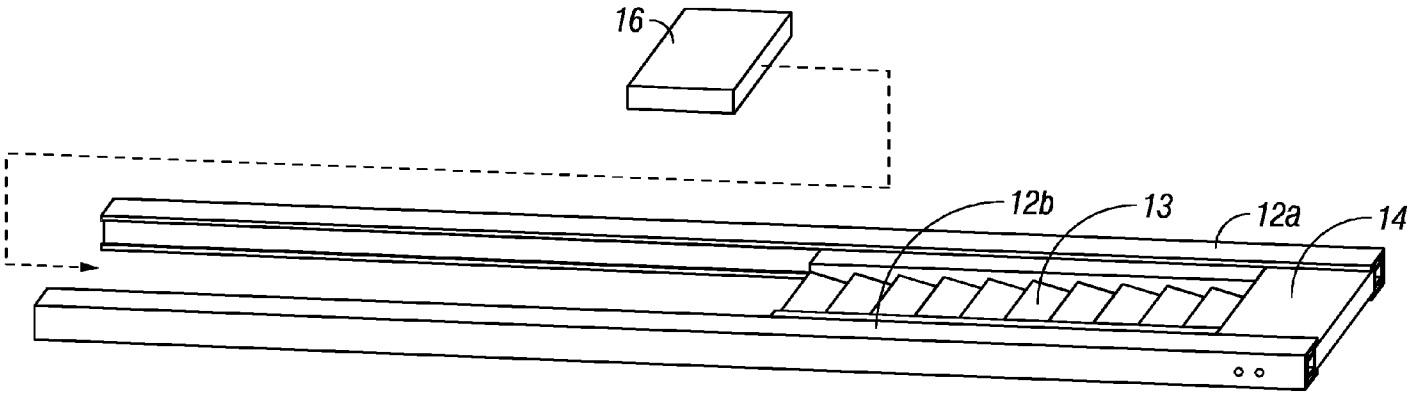
Figure 15D:
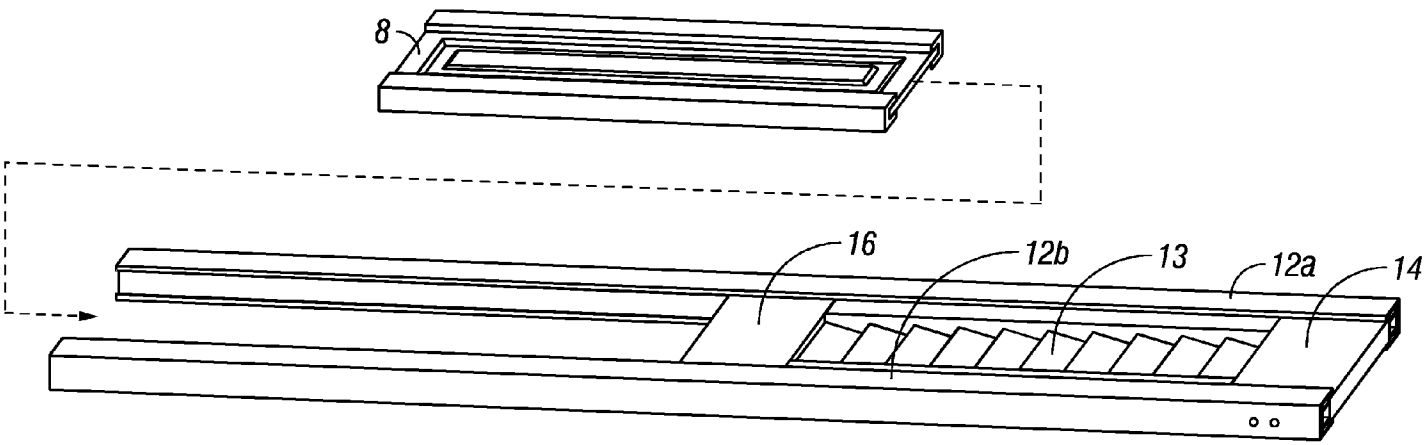
Figure 15E:
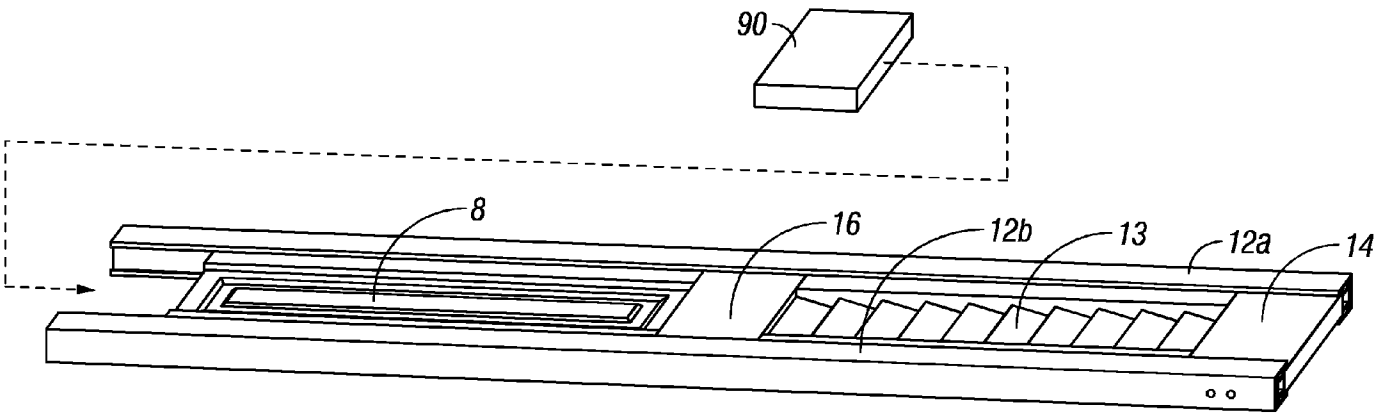
Figure 15F:
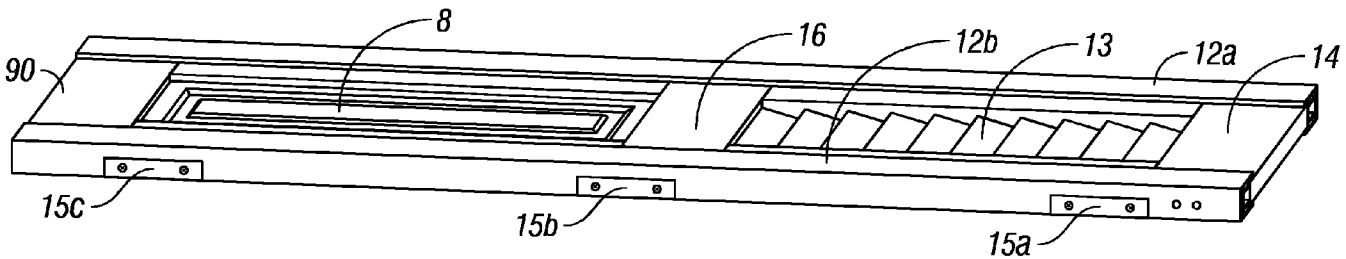

Next, louver assembly 11 having vertical stiles 13 is inserted along the channel 20 in stiles 12*a* and 12*b* through the open end of the closure, as illustrated in FIG. 15B. The second, middle rail 16 is then inserted into the open end of the closure in the direction of the arrows, as illustrated in FIG. 15C, and is fastened to stiles 12*a* and 12*b* via an appropriate fastener extending through reinforcement plate 40 (not shown) extending through interior opening 20*a* of the stiles. Next, panel assembly 8 is inserted along the channel 20 in stiles 12*a* and 12*b*, as shown in FIG. 15D, forming the lower end of the closure. Finally, the rail assembly 90 is inserted into the open end of the closure to securely hold the panel assembly 8 in place, as shown in FIG. 15E. Assembly is substantially complete once rail assembly 90 has been securely fastened to stiles 12*a* and 12*b* using appropriate fasteners and reinforcement plates 40. At this stage, decorative hardware such as a knob for physically moving the closure, and hinges for foldably connecting two panels together to form a bi-fold door, can be attached. FIG. 15F illustrates a finished panel of a bi-fold door in accordance with aspects of the present invention.

Figure 16:
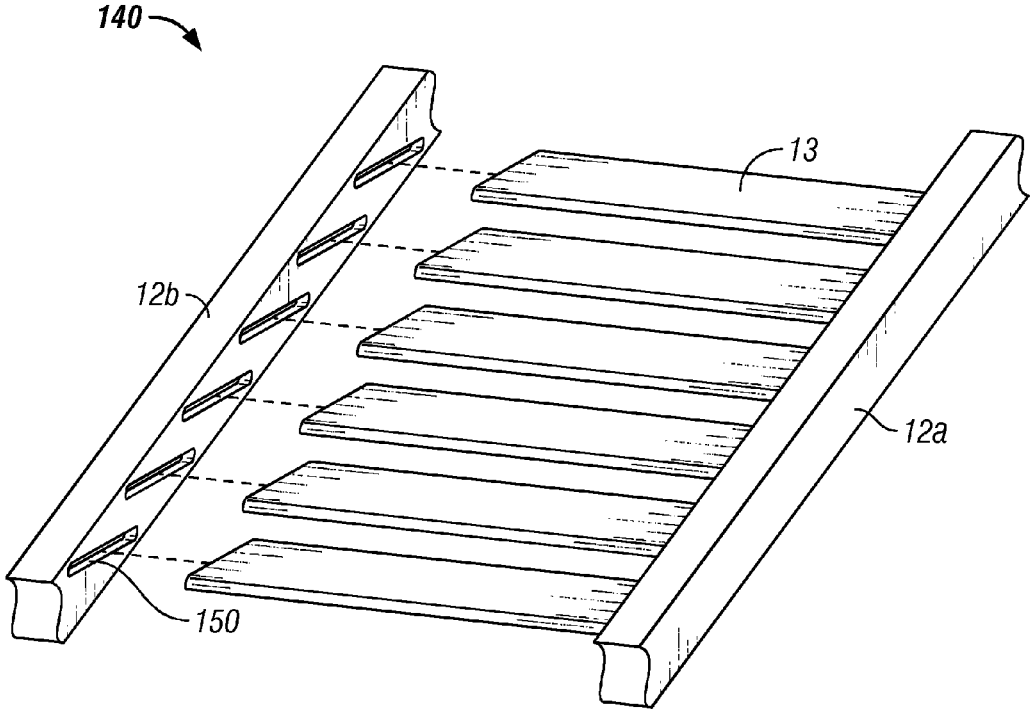
FIG. 16 illustrates an alternative method of assembly of a portion of a closure of the present disclosure.

In accordance with further manufacturing methods of the present disclosure, variations on the method described above may be performed, with equally-acceptable results. For example, all or only selected parts, e.g., the slats, may be extruded or injection molded. In accordance with one variation on this aspect, and by way of example only, the stiles of the closure assembly may be extruded by any appropriate extrusion means, and the slat system could be injection molded, as appropriate, and the closure assembly then assembled off-line. In accordance with a further, equally acceptable aspect, and as illustrated generally by assembly 140 in FIG. 16, one of the side stiles 12*a* may be injection molded in combination with the slats 13, and the opposite, corresponding stile 12*b* could be extruded or injection molded separately, either with the corresponding attachment holes 150 for the slats pre-formed, or the holes could be hole-punched as appropriate, prior to assembly. This closure assembly could then be put together in a standard fashion, as described above. Additionally, in accordance with the above-described methods, the rails, slats and/or stiles may be substantially solid in composition, and may consist of a solid polymer, such as PVC or polystyrene, or a polymer composite composition, such as a wood composite composition or the like.

As suggested above, one or more of the central portions of the closures for use herein may be manufactured so as to have the appearance of a raised-panel door, for increased aesthetic appeal. Such panels may have the raised-panel formed in a number of manners, any of which are acceptable and may be combined with the manufacture and assembly methods outlined herein. Three exemplary, but non-limiting, methods of forming such raised-panel central sections include extrusion methods, vacuum form methods, and injection-molded methods. In accordance with the extrusion methods, the panels may be extruded using known techniques such that they have the desired shape, after which they may be painted as described herein. If the panels are formed by vacuum forming methods, the are typically vacuum-formed into the desired raised-panel shape, using a vacuum-forming assembly, and then painted as appropriate. In addition to these techniques, such raised-panel sections may also be formed by, for example, heat press methods, or using machining techniques, such as router techniques to form the "raised panel" from an appropriately thick blank. In the instance of the use of heat press methods, the panel "blank" is heated to a target temperature in order to make it deformable, and the panel "blank" is then pressed into a mold or using a pre-formed stamp, so as to create the raised-panel effect on the central section of the closure. It may then be painted as desired. Further, and as suggested before, the central panel sections that are substantially solid and having a raised-panel appearance may be manufactured to have a raised-panel appearance on one or both faces (front and back, respectively) of the closure assembly.

The structural, composite material components of the closures of the present disclosure can be made of a variety of composite materials, including any number of suitable polymeric (including polymers, copolylmers, and homopolymers), thermoplastic, or resinous plastic materials, including but not limited to polystyrene, polyvinylchloride (PVC) and modifications thereof (e.g., FR-PVC), polyethylene (PE), polypropylene (PP), poly(acrylonitrile-butadiene-styrene) (ABS) copolymers and resins, acrylonitrile/styrene/acrylate (ASA) polymers, styrene/acrylonitrile (SAN) copolymer resins, poly(butylene terephthalate) (PBT), acrylonitrile/EPDM/styrene (AES) copolymers, low-density polyethylene (LDPE) (such as that coming from mixed post-consumer film waste like grocery bags and shrink wrap), and combinations thereof, as well as polymeric composite compositions that include one or more cellulose-based components, wood substitute components, environmentally-friendly materials such as recycled wood, and combinations thereof. Exemplary composites that comprise one or more polymeric materials and at least one cellulose-based component include foamed wood-fiber composites and polymer-wood composite materials, such as PVC/wood composites known in the art, including monolayer, co-extruded and tri-extruded profiles, as well as mixtures and blends of these materials. Preferably, in accordance with one aspect of the present disclosure, the components for the closures described herein are made of composite materials comprising polyvinyl chloride (PVC) and one or more cellulose-based components and/or one or more wood substitute components, due to such material's mechanical strength, durability, ease of extruding, abrasion resistance, resistance to weathering, chemical rotting, corrosion, and shock, and the light-weight characteristics of the products made from such materials.

The cellulose-based components include, as referenced above, any composition comprising cellulose or a cellulose derivative. Suitable examples of materials which may be used herein as cellulose-based components include but are not limited to wood fibers, wood flour, sawdust, rice hulls, tannin powder, cork dust, demolition wood (DW, wood fiber or flour coming from post-consumer waste), ground plant material, or combinations thereof, as well as materials such as carboxymethylcellulose, methyl cellulose, hydroxymethyl cellulose (HMC), hydroxyethyl cellulose (HEC), hydroxypropyl cellulose (HPC), ethyl-2-hydroxy-ethyl cellulose, cellulose acetate, and the like. Such cellulose-based components may be of any desired size, or may be screened to any desired size for use in combination with a polymer material such as PVC, such sizes ranging from about −60 mesh to about 300 mesh and values in between, inclusive, such as −35 mesh and 40 mesh.

Wood substitute components which may be used in the composites used to form the closures of the present disclosure include, but are not limited to, talc, calcium carbonate (CC), fiberglass (FG), asbestos fibers, stearates, inorganic materials such as clays and mica, starch (including non-plasticized starch and non-gelatinized starch), titanium dioxide ($TiO_2$), and combinations thereof, in any desired particle or mesh size, e.g., −40 mesh to 120 mesh.

In accordance with the present disclosure, the amount of cellulose-based or wood substitute components in the "wood composite" products suitable for use herein ranges from about 0.1 wt. % to about 99 wt. %, inclusive, more preferably from about 0.1 wt. % to about 50 wt. %, more preferably from about 1 wt. % to about 30 wt. %, and more preferably from about 1 wt. % to about 20 wt. %. For example, and without limitation, the wood composite compositions of the present disclosure may include about 0.1 wt. %, about 1 wt. %, about 5 wt. %, about 10 wt. %, about 15 wt. %, about 20 wt. %, about 25 wt. %, about 30 wt. %, about 35 wt. %, about 40 wt. %, about 45 wt. %, about 50 wt. %, about 55 wt. %, about 60 wt. %, about 65 wt. %, about 70 wt. %, about 75 wt. %, about 80 wt. %, about 85 wt. %, about 90 wt. %, about 95 wt. %, and about 99 wt. % cellulose-based components, wood substitute components, or both, as well as compositions having values ranging between any two of these amounts, such as from about 0.1 wt. % to about 15 wt. %, or from about 10 wt. % to about 65 wt. %., without limitation.

In further accordance with an aspect of the present disclosure, the closure made in connection with the compositions and methods described herein may optionally have a composition that includes recycled material, such recycled material ranging in amount from about 0 wt. % to about 100 wt. % recycled material, or more preferably, from about 0.1 wt. % to about 75 wt. % recycled material, as well as amount of recycled materials falling between these ranges, inclusive (e.g., about 5 wt. % or about 25 wt. %).

In addition, the slats 13 which may be included in the compositions as described herein as part of the central, planar structural components, such as illustrated generally in FIG. 1 and FIG. 2, may also be comprised of polymer, co-polymers, and mixtures of copolymers and wood composite, cellulose-based components, or wood-substitute materials, as described above. Alternatively, and equally acceptable, slats 13 may be comprised of a number of other suitable materials, including but not limited to bamboo, woven wood, cloth or fabric, optionally having a print or design imprinted or stitched thereon, hemp, kenaf, rice fibers or rice paper, seaweed or seaweed derivatives, recycled wood flour, recycled wood fibers, recycled materials (including recycled paper and recycled plastics and polymers), as well as mixtures and composites thereof, such as high density polyethylene (PE) and rice hulls.

The materials used to make the components of the present disclosure, especially the polymer-based or polymer-containing materials such as PVC-cellulose based component compositions, can also optionally include one or more of the following ingredients, including but not limited to thickeners such as calcium carbonate; stabilizers, including sizing and heat stabilizers; lubricants, such as ethylene bis-stearamide (EBS), zinc stearate and other metallic stearates, amides and esters, paraffin waxes, oxidized polyethylene, and fatty acids; processing aids, such as acrylates, including methyl methacrylate; impact modifiers for plastics and engineered resins, such as the modified acrylics of the Durastrength® product line available from Arkema (Philadelphia, Pa.); colorants and pigments, such as titanium dioxide and other known suitable pigments, for both aesthetics and for increasing UV resistance and/or increasing color fade resistance (color fastness); foaming agents, such as endothermic and exothermic foaming agents; coupling agents, such as long-chain chlorinated paraffin, maleates (such as polymers having maleic anhydride grafted onto the polymer backbone); metal stabilizers, including chelators; waxes such as paraffin waxes; biocides, such as imidazoles and benzimidazoles (e.g., IRGAGUARD® F and B series products from Ciba Specialty Chemicals, which are thiazolyl benzimidazole), dichloro-octyl-isothiazolone (DCOIT) and DCOIT-based biocides (e.g., VINYZENE™ SB27 from Rohm and Haas), zinc borates, zinc napthenates, chromium copper arsenic (CCA), folpet (FUNGITROL® 11, [N-(trichloromethylthio)phthalimide]) and quaternary ammonium compounds (e.g., Carboquat® from Lonza); fire retardants, such as zinc borate (e.g., Firebrake® ZB), alumina trihydrate, antimony trioxide ($Sb_2O_3$), metal hydroxides such as magnesium hydroxide, organophosphorus fire retardants, melamine-based fire retardants, brominated fire retardants, ammonium polyphosphate (APP), and combinations thereof; UV light stabilizers to protect the product from long-term degradation from exposure to numerous wavelengths of light, including ultraviolet, examples of such UV stabilizers including benzophenones (e.g, 4,4'-dimethylbenzophenone) and related compounds, typically in concentrations ranging from about 0.01 wt. % to about 50 wt. %, as appropriate; and, one or more foaming agents, such as Celogen AZRV, a modified azodicarbonamide available from Chemtura Corp. (Middlebury, Conn.). All of these optional ingredients can be added in an amount sufficient to impart the desired and achieve the desired effect in the final product. For example, and without limitation, a material composition suitable for use within the present invention can comprise about 70 wt. % PVC, about 8 wt. % calcium carbonate, about 18 wt. % UV stabilizer, lubricant, a process aid, an impact modifier, titanium dioxide, wood-chips or wood powder (or the equivalent) and up to about 2 wt. % foaming agent. While compositions described herein preferably comprise at least one cellulose-based material, this is not meant to be limiting. That is, it is envisioned that the compositions described herein may optionally comprise one or more polymers as described above, such as PVC or AES, and have no cellulose-based material or wood-substitute material, and yet still be suitable for use in production of the closures described herein.

The closures described herein can be painted, stained, prefabricated, or pre-extruded to appear to have a number of stains or paint colors that are aesthetically pleasing, using methods known to those of skill in the art. For example, and without limitation, the components of the closures described herein may be pre-extruded with a base color, and then painted with a roller as described above with only one or two passes. Optionally, and equally acceptable, the painting may be done using only a single pass of a roller, as appropriate. Such stains or paints can also act to further enhance the ease of surface cleaning, UV light resistance, warp resistance, and/or moisture resistance associated with such closure assemblies manufactured from the materials as described herein, making them an even more attractive substitute for wood closures, such as wood bi-fold doors.

In the preferred embodiments, the polyvinyl chloride/wood composite closures described herein are painted in a manner such that they impart a variety of aesthetically pleasing, natural wood grain finishes. In accordance with this aspect of the present disclosure, the final closure, or alternatively, specific components of the final closure product, are preferably imparted a "faux wood" appearance through a process comprising a series of paint transfer stations that in combination impart a natural wood grain finish to the external surface of the product. The paint is preferably transferred with one or more printing rollers having at least one wood grain pattern pre-formed on its surface. In a brief overview of the process, the roller picks up paint from a source, such as a kiss coater, and then applies it to the surface of the article. The paint is preferably quick drying, owing to the multiple paint applications typically needed to create the natural wood grain furniture-quality finish. In accordance with one aspect of the present disclosure, the slat will make one pass through a series of paint transfer rollers in an assembly line fashion. Alternatively, and equally acceptable, the slat could make multiple runs through a smaller assembly line, but the handling requirement would make such a process less efficient.

The method of achieving a natural wood grain finish on the surface on the components of the closures described herein typically requires at least two-paint transfers from the one or more printing rollers, and a preferred method requires at least five transfers. While 1 paint transfer can be used, it has generally been found to be unsatisfactory in general appearance, and not a "true" stain; we really need at least 2 passes in order to get the 2 passes. The total number of paint transfers will, however, vary according to the look that is desired, and may range from at least two transfers up to and including thirty transfers, including three transfers, four transfers, five transfers, six transfers, seven transfers, eight transfers, nine transfers, ten transfers, eleven transfers, twelve transfers, thirteen transfers, fourteen transfers, fifteen transfers, sixteen transfers, seventeen transfers, eighteen transfers, nineteen transfers, twenty transfers, twenty-two transfers, twenty-four transfers, twenty-six transfers, twenty-eight transfers, and twenty-nine transfers. In accordance with this process, it should be noted that the natural wood grain "faux wood" finish becomes deeper and richer with each paint transfer step [good statement in favor of 2 or more passes vs. 1]. Since this natural wood grain finish is for aesthetic purposes, each manufacturer must determine the exact number of paint transfers necessary to create the look that they or their customers want, at the target retail price range. Typically, ten to twenty transfers are especially preferred for aesthetic purposes; with the right roller, only need 3 or 4 rollers; can go as many as 10, 20, or 30, but normally after the 2.sup.nd pass to obtain the target product, unless it is a special design.

The type of paint used to create the wood grain look on the closures and related components described herein may be organic solvent-based (e.g., hydrocarbon-based) or water-based, as appropriate, and may also include aerosol organic solvent-based and aerosol water-based paint compositions. Such paint compositions preferably comprise at least one pigment and the appropriate carrier (solvent, such as a hydrocarbon or water). Paint compositions suitable for use herein may further optionally comprise one or more polymers or resins, surfactants and/or dispersants, lubricants, plasticizers, antioxidants, ultraviolet light absorbers, various stabilizers, propellants, antimicrobial agents such as anti-mold compounds, and the like. As the polymers or reins, there may be used polyolefins such as polyethylene, polypropylene, polybutene and polyisobutylene; thermoplastic resins such as polyvinyl chloride, polystyrene, styrene-acrylic ester copolymers, chlorinated resins, styrene-vinyl acetate copolymers and polyamides; rosin-modified maleic acid resins; phenol resins; epoxy resins; polyester resins; ionomer resins; polyurethane resins; silicone resins; rosin-esters; rosins; natural rubbers, synthetic rubbers; or the like, as well as combinations thereof. The additives may be added in an amount of usually not more than about 60% by weight based on the total amount of the pigment and the resin or polymer in the paint. When the amount of the additives added is more than 50% by weight, the obtained resin composition may be deteriorated in moldability.

The amount of the pigment blended in the paint according to the present invention is in the range of usually 0.5 to 100 parts by weight based on 100 parts by weight of a paint base material. In the consideration of handling of the paint, the amount of the pigment blended in the paint is preferably 1.0 to 100 parts by weight based on 100 parts by weight of the paint base material. The paint base material comprises a resin and a solvent, and may further contain, if required, a defoamer, an extender pigment, a drying agent, a surfactant, a hardening accelerator, an assistant or the like.

Examples of the resins used in the paint base material for solvent-based paints may include those ordinarily used for solvent-based paints or oil-based printing inks such as acrylic resins, alkyd resins, polyester resins, polyurethane resins, epoxy resins, phenol resins, melamine resins, amino resins, vinyl chloride resins, silicone resins, rosin-based resins such as gum rosin and lime rosin, maleic acid resins, polyamide resins, nitrocellulose, ethylene-vinyl acetate copolymer resins, rosin-modified resins such as rosin-modified phenol resins and rosin-modified maleic acid resins, petroleum resins or the like. Examples of the resins used in the paint base material for water-based paints may include those ordinarily used for water-based paints or aqueous inks such as water-soluble acrylic resins, water-soluble styrene-maleic acid copolymer resins, water-soluble alkyd resins, water-soluble melamine resins, water-soluble urethane emulsion resins, water-soluble epoxy resins, water-soluble polyester resins or the like.

As the solvent for solvent-based paints, there may be exemplified those solvents ordinarily used for solvent-based paints or oil-based printing inks such as soybean oil, toluene, xylene, thinner, butyl acetate, methyl acetate, methyl isobutyl ketone, glycol ether-based solvents such as methyl cellosolve, ethyl cellosolve, propyl cellosolve, butyl cellosolve and propylene glycol monomethyl ether, ester-based solvents such as ethyl acetate, butyl acetate and amyl acetate, aliphatic hydrocarbon-based solvents such as hexane, heptane and octane, alicyclic hydrocarbon-based solvents such as cyclohexane, petroleum-based solvents such as mineral spirits, ketone-based solvents such as acetone and methyl ethyl ketone, alcohol-based solvents such as methyl alcohol, ethyl alcohol, propyl alcohol and butyl alcohol, aliphatic hydrocarbons or the like.

As the solvents for water-based paints, there may be used a mixture of water and a water-soluble organic solvent ordinarily used for water-based paints or aqueous inks such as alcohol-based solvents such as ethyl alcohol, propyl alcohol and butyl alcohol, glycol ether-based solvents such as methyl cellosolve, ethyl cellosolve, propyl cellosolve and butyl cellosolve, oxyethylene or oxypropylene addition polymers such as diethylene glycol, triethylene glycol, polyethylene glycol, dipropylene glycol, tripropylene glycol and polypropylene glycol, alkylene glycols such as ethylene glycol, propylene glycol and 1,2,6-hexanetriol, glycerin, 2-pyrolidone or the like. As the fats and oils, there may be used boiled oils obtained by processing drying oils such as linseed oil, tung oil, oiticica oil and safflower oil.

In accordance with certain aspects of the present disclosure, it is preferred that the paint be quick drying to improve the efficiency of the process. The paint that is transferred with the printing roller can be any color that contrasts with the background color of the slat. For example, a dark brown or black color would form dark lines on a lighter colored background to create the natural wood grain finish. Finally, the slat can be coated with a clear coat to give it the look of varnished wood. This clear coat can also act to provide protection from ultraviolet light and scratch damage to the wood grain finish.

As recited above, optional embodiments of this disclosure use either a hydrocarbon-based paint or a water-based paint as a base-coat. In the methods utilizing a base-coat, the slat is fed through a painting station wherein a base-coat is first applied to the slat. After this base-coat dries, a series of paint transfers is applied over the base-coat to impart a natural wood grain finish, just as it is done in the previously disclosed preferred embodiment, using one or more paint transfer rollers. The color of this base-coat can be varied to simulate various types of natural wood, such as oak, cedar, mahogany, bamboo, or cherry, or to give the illusion of a stained wood product. Typically, colors ranging from beige to brown are suitable base-coats, although base-coats which are lighter or darker, such as black or red, are also suitable for use herein.

Additionally, and as suggested previously herein, the closures can be of any number of styles with regard to the center panels, including but not limited to louver/louver, louver/panel, panel/panel, and panel/panel/panel, among others. In accordance with this aspect, the louvers 13 in louvered panels used with the closures of the present invention can be of any appropriate width, preferably from about 1 inch to about 4 inches, and more preferably about 3-inches in width. [also, 2-inches].

Further additional embodiments of the present disclosure include the inclusion of one (or more) solid stiles for the closure, especially in the instance of interior or exterior closures, wherein the solid stile would allow for a hinge to be mortised and set into place in a standard manner, such that the hinge is flush-mounted with respect to the exterior surface of the stile. Optionally, and equally acceptable, one or more components of the closures described herein may be reinforced with wood, metal, plastic, or other suitable reinforcement means, while allowing the closures to remain lightweight. For example, in accordance with one aspect of the present disclosure, a plurality of the components of the closure itself, such as the rails and the stiles, but excluding the slats, may include a metal reinforcement means within their interior, so as to provide added strength to the closures.

While compositions and methods are described in terms of "comprising" various components or steps (interpreted as meaning "including, but not limited to"), the compositions and methods can also "consist essentially of" or "consist of" the various components and steps, such terminology should be interpreted as defining essentially closed-member groups.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intends to protect all such modifications and improvements to the full extent that such falls within the scope or range of equivalent of the following claims.

What is claimed is:

1. A method of assembling a door, the method comprising the steps of:

providing two door stiles, each stile having a channel therein;

securing a first rail within the channel of each door stile, thereby forming three sides of the door;

inserting a first assembly into the channel of the door stiles;

inserting a second rail within the channel of each door stile;

inserting a second assembly into the channel of the door stiles; and securing a third rail within the channel of each door stile;

wherein the third rail comprises a substantially hollow portion and a substantially solid portion and further including the step of cutting the substantially solid portion, thereby trimming a height of the door to fit a desired opening.

2. The method as set forth in claim 1, wherein the first and third rails are secured within the door stiles using a plurality of reinforcement plates within each door stile.

3. The method as set forth in claim 1, wherein the first, second, and third rails are secured within the door stiles using a plurality of reinforcement plates within each door stile.

4. The method as set forth in claim 1, wherein the first and third rails are secured within the door stiles using a single reinforcement plate within each door stile.

5. The method as set forth in claim 1, wherein the first, second, and third rails are secured within the door stiles using a single reinforcement plate within each door stile.

6. The method as set forth in claim 1, wherein the first assembly comprises a louver assembly with slats secured between two assembly stiles.

7. The method as set forth in claim 1, wherein the second assembly comprises a louver assembly with slats secured between two assembly stiles.

8. The method as set forth in claim 1, wherein the second assembly comprises a panel assembly with a panel secured between two assembly stiles.

9. The method as set forth in claim 1, wherein the substantially solid portion is slidably received within the substantially hollow portion.

10. The method as set forth in claim 1, wherein the substantially solid portion, extends below the substantially hollow portion.

11. The method as set forth in claim 1, wherein the first rail is secured within the channels of the door stiles at a first end of the door stiles and wherein the first assembly, the second rail, the second assembly, and third rails are all slid into a second end of the door stiles toward the first end, the second end being distal from the first end.

12. The method as set forth in claim 11, wherein the first assembly is slid from the second end to a position abutting the first rail, wherein the second rail is slid from the second end to a position abutting the first assembly, wherein the second assembly is slid from the second end to a position abutting the second rail, and wherein the third rail is slid from the second end to a position abutting the second assembly.

13. A method of assembling a door, the method comprising the steps of:

providing two door stiles, each stile having a channel therein;

securing a first rail within the channel of each door stile at a first end of the door stiles, thereby forming three sides of the door;

sliding a first assembly into the channel of the door stiles from a second end of the door stiles toward the first end, the second end being distal from the first end, the first assembly having assembly stiles configured to fit within the channels of the door stiles;

sliding a second rail within the channel of each door stile from the second end toward the first end;

sliding a second assembly into the channel of the door stiles from the second end toward the first end, the second assembly having assembly stiles configured to fit within the channels of the door stiles; and securing a third rail within the channel of each door stile;

wherein the third rail comprises a substantially hollow portion and a substantially solid, rigid portion slidably received within the substantially hollow portion and further including the step of cutting the substantially solid portion, thereby trimming a height of the door to fit a desired opening, such that the door does not contact a floor beneath the door.

14. The method as set forth in claim 13, wherein the first and second assemblies each comprise a louver assembly with slats secured between the assembly stiles.

15. The method as set forth in claim 13, wherein the first assembly comprises a louver assembly with slats secured between the assembly stiles and the second assembly comprises a panel assembly with a panel secured between the assembly stiles.

16. A method of assembling a door, the method comprising the steps of:

providing two door stiles, each stile having a channel therein;

securing a first rail within the channel of each door stile at a first end of the door stiles, thereby forming three sides of the door;

sliding a first assembly into the channel of the door stiles from a second end of the door stiles to a position abutting the first rail, the second end being distal from the first end, the first assembly having assembly stiles configured to fit within the channels of the door stiles;

sliding a second rail within the channel of each door stile from the second end to a position abutting the first assembly;

sliding a second assembly into the channel of the door stiles from the second end to a position abutting the second rail, the second assembly having assembly stiles configured to fit within the channels of the door stiles;

providing a third rail comprising a substantially hollow portion and a substantially solid portion slidably received within the substantially hollow portion;

cutting the substantially solid portion, thereby trimming a height of the door to fit a desired opening; and securing the third rail within the channel of each door stile to a position abutting the second assembly.

17. The method as set forth in claim 1, wherein the substantially solid portion is rigid.

18. The method as set forth in claim 1, wherein the substantially solid portion is cut so as to avoid contact with a floor below the door.

19. The method as set forth in claim 16, wherein the substantially solid portion is rigid.

20. The method as set forth in claim 1, wherein the substantially solid portion is cut so as to avoid contact with a floor below the door.

* * * * *